US007346309B2

(12) United States Patent
Nakamura et al.

(10) Patent No.: US 7,346,309 B2
(45) Date of Patent: Mar. 18, 2008

(54) BOOKBINDING SYSTEM AND IMAGE FORMING SYSTEM

(75) Inventors: Hideki Nakamura, Hachioji (JP); Eiji Sugimoto, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 334 days.

(21) Appl. No.: 11/143,555

(22) Filed: Jun. 2, 2005

(65) Prior Publication Data

US 2006/0029445 A1 Feb. 9, 2006

(30) Foreign Application Priority Data

Aug. 5, 2004 (JP) ..... 2004-229140
Aug. 16, 2004 (JP) ..... 2004-236424
Aug. 16, 2004 (JP) ..... 2004-236425

(51) Int. Cl.
*G03G 15/00* (2006.01)

(52) U.S. Cl. ..... 399/408

(58) Field of Classification Search ..... 399/69, 399/82, 85, 88, 362, 408; 358/1.1; 412/8, 412/11, 14, 902
See application file for complete search history.

(56) References Cited

U.S. PATENT DOCUMENTS 5,240,362 A * 8/1993 Nakayama et al. ..... 412/11
5,854,957 A * 12/1998 Morikawa ..... 399/38
6,076,817 A * 6/2000 Kobayashi et al. ..... 270/58.09
6,213,456 B1 * 4/2001 Hirano et al. ..... 270/58.08
7,151,908 B2 * 12/2006 Iwai et al. ..... 399/408

FOREIGN PATENT DOCUMENTS

JP 09204115 A * 8/1997
JP 09-323488 12/1997
JP 11035221 A * 2/1999
JP 2000-098799 A 4/2000
JP 2003-291558 A 10/2003

* cited by examiner

*Primary Examiner*—Robert Beatty
(74) *Attorney, Agent, or Firm*—Frishauf, Holtz, Goodman & Chick, P.C.

(57) ABSTRACT

The invention provides an image forming system which includes an image forming device and a post-processor, and complete warming-up of the image forming device in a short time with a limited power supply. The invention further provides an image forming system which includes an image forming device and a post-processor, and enables saving consumption power consumed by the heating section of the post-processor if the heating section is used at long intervals. The invention yet further provides an image forming system which has an image forming device and a bookbinding device, and reduces the maximum consumption power, with a simple structure.

9 Claims, 17 Drawing Sheets

FIG. 9 ( b )
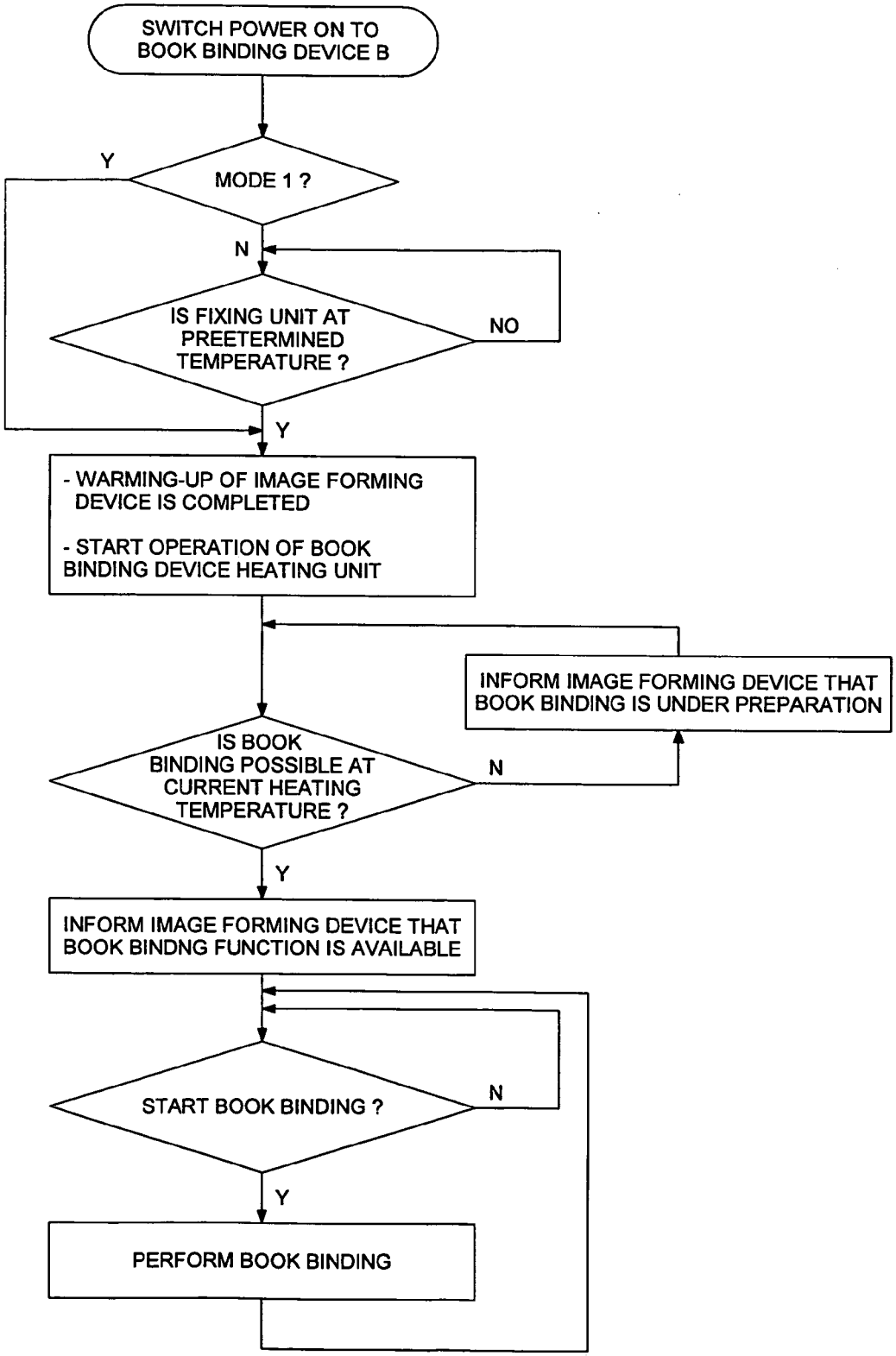

BOOKBINDING SYSTEM AND IMAGE FORMING SYSTEM

FIELD OF THE INVENTION

The present invention relates to image forming systems provided with an image forming device and a post-processing (sheet finishing) device with heaters.

BACKGROUND OF THE INVENTION

Bookbinding systems are already present in which a bookbinding device is connected to an image forming device in an online manner, and the sheets after image formation ejected from the image forming device are bound into the form of a booklet by stitching the bundle of sheets in a bookbinding device. One bookbinding method by the use of such a bookbinding system is a method by stitching heating and pressing against the edge parts of the bundle of sheets a tape (the binding tape) which has a base material of paper or cloth cut in the form of a tape coated with a hot melt type adhesive that becomes soft and melts by heating, and this method is usable for binding very important papers because, even when the number of pages is large, there is no limitation due to the length of the stapling wire and also the appearance or the finish of the bound book is good.

In the method of bookbinding using a binding tape, the sheets with images formed on them and ejected by an image forming device on the upstream side are successively stacked one upon another, and after a bundle of sheets is formed by arranging the sheets, they are bound by pressing a binding tape against the edge part of the bundle of sheets while heating and pressing the binding tape by a heating member thereby transferring to the bundle of sheets the hot melt type of adhesive that has become soft and has been melted by heating. The heating member is separated from the binding tape after the transfer of the adhesive to the bundle of sheets has been completed. Since the temperature of the hot melt type adhesive returns to room temperature when the heating member is separated from it, the adhesive is hardened whereupon the binding tape and the bundle of sheets get fixed to each other thereby completing the binding operation.

Most binding means are a type which binds the edge portion of a bundle of sheets by a stapler or a type which binds a bundle of sheets by coating a hotmelt adhesive on the front edge surface the bundle. Further, there is offered means which coats glue at the edge portion of sheets ejected from an image forming device, stacks the sheets while arranging them, and finally presses the edge portion, of the sheets, having the glue coated thereon to bind the bundle of sheets (for example, see Patent Document 1). The above described respective means have respective features, allowing it to select a proper means, depending on a purpose of bookbinding.

The heating member is heated and melts the adhesive of the binding tape by pressing it against the binding tape. The heating member is needed to heat the binding tape uniformly within a short time, and accordingly aluminum having a satisfactory thermal conductivity or stainless steel having a satisfactory thermal accumulation property is used as the material of the heating member. The member is heated by providing heaters on the surface opposite to this surface in contact with the binding tape.

Since the member is required to have the strength necessary for withstanding the pressure of pressing against the binding tape and also to have a uniform temperature distribution, its thermal capacity becomes large. As a consequence, the time from starting the current flow to the heater until the member reaches a predetermined temperature suitable for bookbinding, that is, a so-called warming-up time is long, and hence sometimes the waiting period becomes long before starting image forming operations even when preparation has been completed in the image forming device.

As a measure to shorten the warming-up time of post-processing devices as much as possible under limited conditions, there have been proposals in which a plurality of heaters are provided for the heating member of a post-processor and the temperature of the entire heating member is raised uniformly by controlling the distribution of power supplied to these heaters (for example, see Patent Document 2).

Patent Document 1: Japanese Unexamined Patent Application Laid-Open TOKKAI No. 2003-291558 (Page 1-2)

Patent Document 2: Japanese Unexamined Patent Application Laid-Open TOKKAIHEI No. 9-323488 (Page 1).

In order to shorten the warming-up time of the post-processor described in Patent Document 1 and Patent Document 2, although it is possible to consider increasing the capacity of the heaters and supplying a larger power, normally, there is a limit on the power supply capacity of the power distribution-panel or the power supply socket to which the device is connected, and hence the power that can be used for this will naturally be limited. In particular, when a post-processor is connected to an image forming device having a fixing unit that uses heated rollers, since it becomes necessary to supply electric power for warming-up to a plurality of heaters at the same time, the electric power that can be supplied to each individual heater is limited, and hence it is likely that the overall warming-up time of the entire image forming system including an image forming device and a post-processor is longer in spite of taking this measure.

In addition, depending on the environment of use by the user, there are cases where a post-processor that binds the bundle of sheets using a hot melt type of adhesive is always used and there are cases where such a device is not always used. In the case where a post-processor is always used, it is required that the warming-up of the post-processor is completed in a short period of time. In the other case where it is not always used, it is necessary that the power consumption be reduced to the lowest possible limit during when the post-processor is not used.

The present invention was made with consideration of the above conditions, and a first object of the present invention is to provide an image forming system in which it is possible to complete warming-up of the image forming device in a short time under conditions in which there are limitations on the usable electric power. In addition, a second object of the present invention is to provide an image forming system in which it is possible to save the electric power consumed in the heating section of a post-processor under conditions where the heating section of the post-processor is used at long intervals.

On the other hand, in a bookbinding system in which a bookbinding device is connected to an image forming device, the power supply of the bookbinding device is generally switched on when the power supply of the image forming device is switched on. If the bookbinding system is started due to either switching on the power of the image forming device or start from a low consumption power mode such as a power saving mode or a sleep mode, the warming-up of the image forming device and the warming-up of the bookbinding device are started simultaneously. In a known bookbinding system, the power consumption during warming-up is high because the supply of electric power to the image forming device and to the heating units of the bookbinding device are started at the same time as switching on the power of the image forming device or start from an energy saving mode. In particular, at the time the power supply is switched on or at the time of starting from a low consumption power mode, since the temperatures of the heater of the heating units of both devices are low, the power consumption becomes even higher and hence the power consumption in a bookbinding system becomes a maximum at the time the power supply is switched on or at the time of starting from a low consumption power mode.

However, when installing a bookbinding system, the user has to select an image forming device and a bookbinding device based on a usable power distribution panel or an electric power that can be supplied from a power socket. Even when the power supply capacity of a power distribution panel or a power supply socket is limited, an image forming device may be installed, depending on the power supply capacity of the power distribution panel or the power supply socket. However, if a bookbinding device is added, the power consumption may exceed the amount of electric power that can be supplied. In such a case, the user is forced either to give up the introduction of a bookbinding system or to enable the introduction by carrying out facility enhancement work of increasing the power supply capacity of the power distribution panel or of the power supply socket.

On the other hand, as a method of reducing the power supplied from a commercial power supply to an image forming device, it has been proposed to heat the fixing units of the image forming device using a main heater driven by power from the commercial power supply and an auxiliary heater driven by DC current supplied by a built in storage battery (see, for example, Patent Document 3), this would require a circuit unit for rectification and charging and a storage battery circuit unit, whereby the construction becomes unavoidably complicated. In addition, although it is possible to reduce the maximum power consumption by properly distributing the power supplies given to the image forming device and the bookbinding device constructing the bookbinding system while monitoring the temperatures of heaters of both devices, such a method is not practical, as it would require a complicated structure. So far there has been no bookbinding system that can reduce the maximum power consumption, with a simple structure.

In this manner, there is a desire to connect a bookbinding device having a heating unit to a known image forming device and use them as a bookbinding system. However, depending on the power supply capacity of a power distribution panel or of a power supply socket that can be used, there are many limitations imposed on users, requiring them either to give up their desire or to carry out facility enhancement work of increasing the power supply capacity of the power distribution board or of the power supply socket.

Patent Document 3: Japanese Unexamined Patent Application Laid-Open TOKKAI No. 2000-98799

In this point of view, a third object of the present invention is to reduce the maximum power consumption in an image forming system having an image forming device and a bookbinding device that includes a heating section while having a simple system structure.

SUMMARY OF THE INVENTION

Objects described above can be attained by the following structures.

Structure A: An image forming system includes an image forming device; and a post-processor for performing post-processing on a recording medium on which an image has been formed by the image forming device, the post-processor having a heating section, wherein the image forming system includes a job input section for inputting a print job; a print job recognition section for recognizing the print job; and a control section for controlling a temperature of the heating section, according to a result recognized by the print job recognition section.

Structure B: An image forming system includes an image forming device; and a post-processor for performing post-processing on a recording medium on which an image has been formed by the image forming device, the post-processor having a heating section, wherein the image forming system includes a first trigger detection section for detecting a first arming-up start trigger; a second trigger detection section for detecting a second warming-up start trigger; a control section for controlling warming-up of the heating section; and a setting section for setting a first mode or a second mode, wherein, if the first mode has been set at the setting section, the control section starts warming-up of the heating section in response to a detection of the first warming-up start trigger by the first trigger detection section, and if the second mode has been set at the setting section, the control section starts warming-up of the heating section in response to a detection of the second warming-up start trigger by the second-trigger detection section.

Structure C: An image forming system includes an image forming device having a heating section; and a post-processor for performing post-processing on a recording medium on which an image has been formed by the image forming device, the post-processor having a heating section, wherein the image forming system has a first mode that starts warming-up of the heating section of the image forming device and warming-up of the heating section of the post-processor in response to a first warming-up start trigger, and a second mode that starts warming-up only of the heating section of the image forming device out of the heating section of the image forming device and the heating section of the post-processor in response to a second warming-up start trigger.

Structure D: An image forming system includes an image forming device having a fixing unit for fixing an image on a recording medium by heating; a bookbinding device having a bookbinding unit provided with a heating unit for melting an adhesive for binding a bundle of sheets of the recording medium; and a control unit for controlling warming-up of the bookbinding device so that the warming-up of the bookbinding device is performed after completion of warming-up of the image forming device, wherein the image forming device and the bookbinding device are connected with each other.

DETAILED DESCRIPTION OF THE PREFERRED EMBODIMENTS

Figure 1:
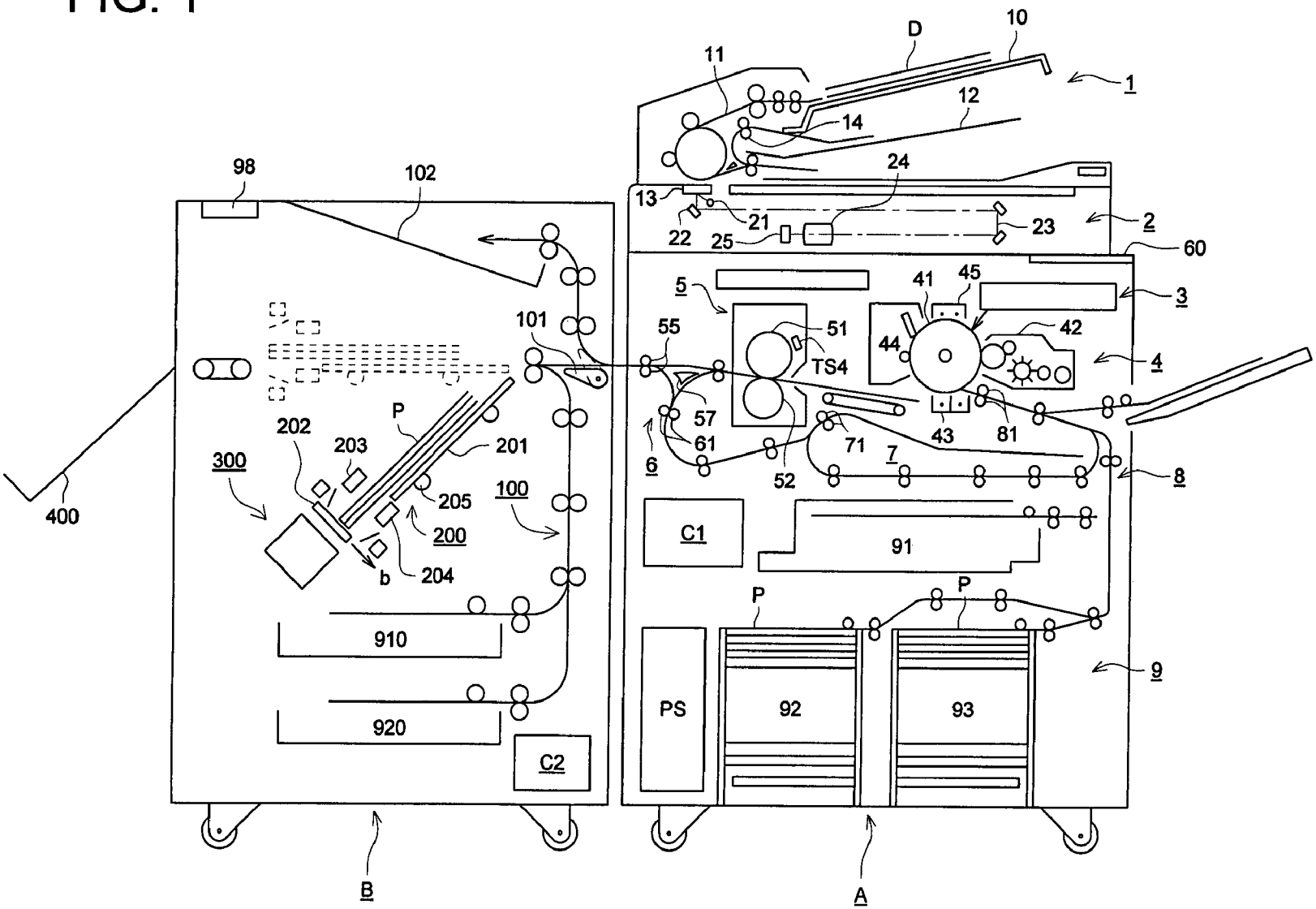
FIG. 1 is a conceptual diagram showing a bookbinding system including an image forming device and a bookbinding device.

First, preferred structures in accordance with the present invention that achieve the above objects will be described below.

Item 1-1: A bookbinding system includes an image forming device having a fixing unit for fixing an image on a recording medium by heating, a bookbinding device having a bookbinding unit provided with a heating unit for melting an adhesive for binding a bundle of recording medium sheets, and a control unit for controlling warming-up of the bookbinding device to be performed after warming-up of the image forming device is completed. Herein, the image forming device and the bookbinding device are connected with each other.

Item 1-2: An image forming device connectable to a post-processor having a heating unit includes a fixing unit for fixing an image on a recording medium by heating, and a control unit for controlling warming-up of the post-processor to be performed after completion of warming-up of the image forming device.

Item 1-3: In the image forming device of Item 1-2, the post-processor is a bookbinding device having a heating unit for melting an adhesive to bind the bundle of sheets of the recording medium.

According to the structure in Items 1-1 to 1-3 described above, in a bookbinding system in which the image forming device and the bookbinding device are connected to each other, since the warming-up of the bookbinding device is carried out after completion of the warming-up of the image forming device, the warming-up of the two devices are not carried out at the same time and hence it is possible to reduce the maximum power consumption of the bookbinding system.

Item 2-1: An image forming system performs post-processing on a recording medium on which an image has been formed by an image forming device, with a processing material heated by a heating unit. The system also includes a first trigger detection unit for detecting a first warming-up start trigger, a second trigger detection unit for detecting a second warming-up start trigger, a warming-up control unit for controlling warming-up of the heating unit, and a setting unit for setting the first mode or the second mode. Herein, if the first mode has been set via the setting unit, then the control unit starts warming-up of the heating unit in response to a detection of the first warming-up start trigger by the first trigger detection unit, and if the second mode has been set via the setting unit has set, then the control unit starts warming-up of the heating unit in response to a detection of the second warming-up start trigger by the second trigger detection unit.

Item 2-2: In the image forming system of Item 2-1, the start of warming-up of the heating unit by the warming-up control unit is a change from a state where current is not flowed through the heating unit to a state where current is flowed through the heating-unit.

Item 2-3: In the image forming system of Item 2-1 or 2-2, the first warming-up trigger includes at least one selected from switching power on to the post-processor and switching power on to the image forming device, and the second warming-up start trigger is post-processing data.

According to Item 2-1, if the first mode has been set via the setting unit, the warming-up of the heating unit of the post-processor is started when the first trigger detection unit detects the first warming-up start trigger, and, if the second mode has been set by the setting unit, the warming-up of the heating unit is started when the second trigger detection unit detects the second warming-up start trigger. Therefore, it is possible to make detailed warming-up setting and power saving setting, depending on the conditions of use of the image forming device and the post-processor.

For example, in the first mode, the warming-up of the heating unit of the post-processor is started immediately after switching on power is detected as the first warming-up start trigger. Therefore, in an environment where the post-processor is frequently used, a long time is not required for the warming-up of the post-processor after the completion of warming-up. In the second mode, the warming-up of the heating unit of the post-processor is not carried out until the second warming-up start trigger is detected. Therefore, it is possible to use a high electric power for the warming-up of the image forming device after switching on power to the image forming device, whereby it is possible not only to complete the warming-up of the image forming device in a short period but also to save the power consumption. In other words, under conditions in which the power supply is limited, it is possible to complete the warming-up of the image forming device within a short period, and it is possible to save the electric power consumption by the heating unit under conditions in which the heating unit is used at long intervals.

According to Item 2-2, since no current is flowed through the heating unit before starting the warming-up, it is possible to achieve highly effective power savings.

According to Item 2-3, as the first warming-up start trigger is switching on power supply to the post-processor or switching on power supply to the image forming device, it is possible to start the warming-up of the post-processor without delay after switching on power supply. Further, as the second warming-up start trigger is post-processing setting-data, it is possible for the warming-up control unit to carry out power saving control having a large effect.

Item 3-1: An image forming system carries out post-processing on a recording medium on which an image has been formed by an image forming device having an image forming unit, which forms an image on a recording medium based on a print job, and a print job storage unit that stores a print job. The system includes a heating unit for heating a processing material for carrying out post-processing on the recording medium on which an image has been formed by the image forming device, a temperature detection unit that detects the temperature of the heating unit, a heating temperature control unit that controls the temperature of the heating unit, based on the temperature detected by the temperature detection unit, and a print job determination unit that determines a print job stored in the print job storage unit. Herein, the heating temperature control unit carries out control of the temperature of the heating unit, based on a result determined by the print job determination unit.

Item 3-2: In the image forming system of Item 3-1, if the print job determination unit has determined that the print job includes post-processing data for the recording medium on which the image has been formed by the image forming device, then the control unit raises the temperature of the heating unit.

Item 3-3: In the image forming system of Item 3-1, if the print job determination unit has determined that the print job includes post-processing data for the recording medium on which the image has been formed by the image forming device, then the control unit controls the temperature of the heating unit to be a first temperature, and if the print job determination unit has determined that the print job does not include post-processing data, or a print job is not present, then the control unit controls the temperature of the heating unit to be a second temperature.

Item 3-4: A control method, of an imaging forming system, controls an image forming system that has a heating unit for heating a processing material and carries out post-processing on a recording medium on which an image has been formed by an image forming device. The image forming device has an image forming unit for image forming on a recording medium, according to a print job, and a print job storage unit for storing a print job. The method includes a print job determination process for determining a print job stored in the print job storage unit, and a heating temperature control process for controlling the temperature of the heating unit, according to a result determined by the print job determination process.

According to Item 3-1, the heating temperature control unit controls the temperature of the heating unit, according to a result of determination made by the print job determination unit that determines a print job stored in the print job storage unit. Therefore, it is possible to carry out temperature control of the heating unit, according to a content of the print job. According to Item 3-2, if the print job determination unit has determined that the print job includes post-processing data, then the heating temperature control unit raises the temperature of the heating unit. Therefore, it is possible to raise the temperature of the heating unit to a required temperature only when post-processing is needed.

According to Item 3-3, if the print job determination unit has determined that the print job includes post-processing data, then the heating temperature control unit controls the temperature of the heating unit to be at the first temperature. If the print job determination unit has determined that the print job does not include post-processing data, or a print job is not present, then the control unit controls the temperature of the heating unit to be a second temperature. Therefore, it is possible to control the temperature of the heating unit, according to whether or not post-processing data is present.

For example, it is possible to achieve energy savings by controlling the heating unit at a temperature required for post-processing when post-processing is necessary, and by controlling the heating unit at a lower temperature when post-processing is not necessary.

According to the method of Item 3-4, the heating temperature control unit controls the temperature of the heating unit, based on a result of determination made in the print job determination process for determining a print job stored in the print job storage unit. Therefore, it is possible to control the temperature of the heating unit, according to a content of a print job.

The structure and effects of a bookbinding system applied with the present invention will be described below, referring to drawings. The present embodiment is a bookbinding system in which is connected to an image forming device a bookbinding device that binds a bundle of sheets by heating and melting a binding adhesive using a heating unit.

FIG. 1 is a conceptual diagram showing a bookbinding system including an image forming device and a bookbinding device. An image forming device A is a digital type copier that forms images using the electro-photographic technology, and a bookbinding device B is connected to it.

The image forming device A includes an automatic document feeding unit 1, a reading unit 2, a writing unit 3, an image forming unit 4, a fixing unit 5, a sheet reverse/ejection unit 6, a sheet refeeding unit 7, a sheet transporting unit 8, a sheet feeding unit 9, a control unit C1, and an operation/display unit 60, etc.

The automatic document feeding unit 1 sends out the document D placed on a document loading table 10 one sheet by one sheet to a document transport path 11, and ejects the documents on to the document eject table 12. The image surface of the document D during transport is read out by the reading unit 2 at a document reading position 13. When reading the images on both sides of the document D, the document D whose first side has been read out is reversed by a reversing unit 14 and is again sent to the document transport path 11, whereupon the second surface is read out and the document is ejected to the document eject table 12.

The reading unit 2 includes a light source 21, a first mirror unit 22, a second mirror unit 23, an image forming lens 24, and a CCD 25 etc., and scans an image on the document D moving at the image reading position 13, forms the image on the CCD 25, and converts the document image data which is optical data into electrical data. The converted document image data is subjected to processings such as A/D conversion, shading correction, compression etc., and is then stored in the memory M1 of the control unit C1. The writing unit 3 is a scanning optical system including a laser light source, cylindrical lens, Fθ lens, mirror, polygon, etc., and forms a latent image on the surface of a photosensitive body 41 by scanning the surface of the photosensor 41 of the image forming unit 4 with a laser beam that changes in accordance with the image data read out from the memory M1.

The image forming unit 4 carries out developing operation on the latent image formed on the surface of the photosensitive body 41 with the developing unit 42 to visualize it as a toner image. The toner image is transferred by the image transfer unit 43 onto a sheet P sent out by a registration roller 81. The surface of the photosensitive body 41 after the transfer of the toner image has been completed is cleaned of the residual toner by a cleaning unit 44, charged by an electrostatic charging unit 45 and sent for the formation of the next latent-image.

The fixing unit 5 fixes the toner image on the sheet P by heating and applying pressure on the sheet P carrying a toner image, using the heat roller 51 and a pressure roller 52 which are placed facing each other. The heat roller 51 is heated by a heater, not shown in the figure, and the temperature of the heat roller 51 is detected by a temperature detection unit TS4. The control of heating or temperature maintenance of the heat roller 51 is carried out by the control unit, based on the result of detection by the temperature detection unit TS4.

The sheet P after completion of image fixing is sent to the bookbinding device B by the sheet eject roller 55. In order to eject the sheet P after reversing it, the sheet P is guided towards the lower side by a sheet eject guide 57, the trailing edge of the sheet P is sandwiched by a reversing roller 61 of the reversing unit, then the sheet P is reversed and sent to the sheet eject roller 55. When carrying out image formation on both sides of the sheet P, the sheet P is sent to the sheet refeeding unit 7 via the sheet eject guide 57 and a plurality of rollers, reversed by the reversing roller 71 of the sheet refeeding unit 7, and sent again to the sheet transporting unit 8.

The sheet transporting unit 8 is a transportation path of sheets including a plurality of rollers and guide members. The sheet transporting unit 8 transports the sheet P sent out from the sheet feeding unit 9, pushes the front edge of the sheet P against the registration roller 81, and sends the sheet P towards the photosensitive body 41 so that the toner image is received.

The sheet feeding unit 9 includes a first sheet feeding unit 91 that has a small tray capacity, a second sheet feeding unit 92 that has a large tray capacity, and a third paper feeding unit 93. Each of the sheet feeding unit has a sheet ejection roller that sends out sheets P one by one from the respective tray to the sheet transporting unit 8.

The operation/display unit 60 is a touch panel installed on the top surface of the body of the image forming device A, has both the functions of input and display, and is used for giving instructions to the control unit C1 related to, for example, setting the number of copies to be made and setting whether or not to perform bookbinding. In addition, this unit also has the function of displaying job data that has been input, the operating status of the image forming device A or the bookbinding device B, necessary warnings, etc.

If the mode of not carrying out bookbinding has been selected using the operation/display unit 60, the sheets P on which image formation has been done by the image forming device A and which have been sent out to the bookbinding device B are guided by the separation guide 101 to be transported upward and are ejected onto the sheet eject table 102.

When the mode of carrying out bookbinding has been selected, sheets P by the number of pages to make one copy of a book are successively sent to a sheet arranging unit 200 and stacked. In addition, it is also possible to stack cover sheets and/or sheets to be inserted between pages on the sheet loading unit 910 and 920, and to send these sheets from the sheet transporting unit 100 to the sheet arranging unit 200 so that the stacked sheets are inserted at the predetermined page number positions.

The sheet arranging unit 200 is structured by a sheet loading table 201, a front edge restricting plate 202, sheet pressure contact members 203 and 204, and sheet width restricting plates (not shown in the figure), etc. The sheets P stacked on the sheet loading table 201 have their front edges restricted by the front edge restricting plate 202 and their both side edges restricted by the width restricting plates thereby becoming an arranged bundle of sheets.

When the stacking of the last page on the sheet loading table 201 is completed, the sheet pressure contact members 203 and 204 press the bundle of sheets P at the front edge from the top and from the bottom thereby tightly sandwiching the bundle of sheets so that the arrangement of the sheets is not broken. When this tight sandwiching by the sheet pressure contact members 203 and 204 is completed, the front edge restricting plate 202 moves in the direction of arrow b shown in the figure and the front edge of the bundle of sheets butts against the bookbinding unit 300 with the binding tape TT placed in between.

Figure 2:
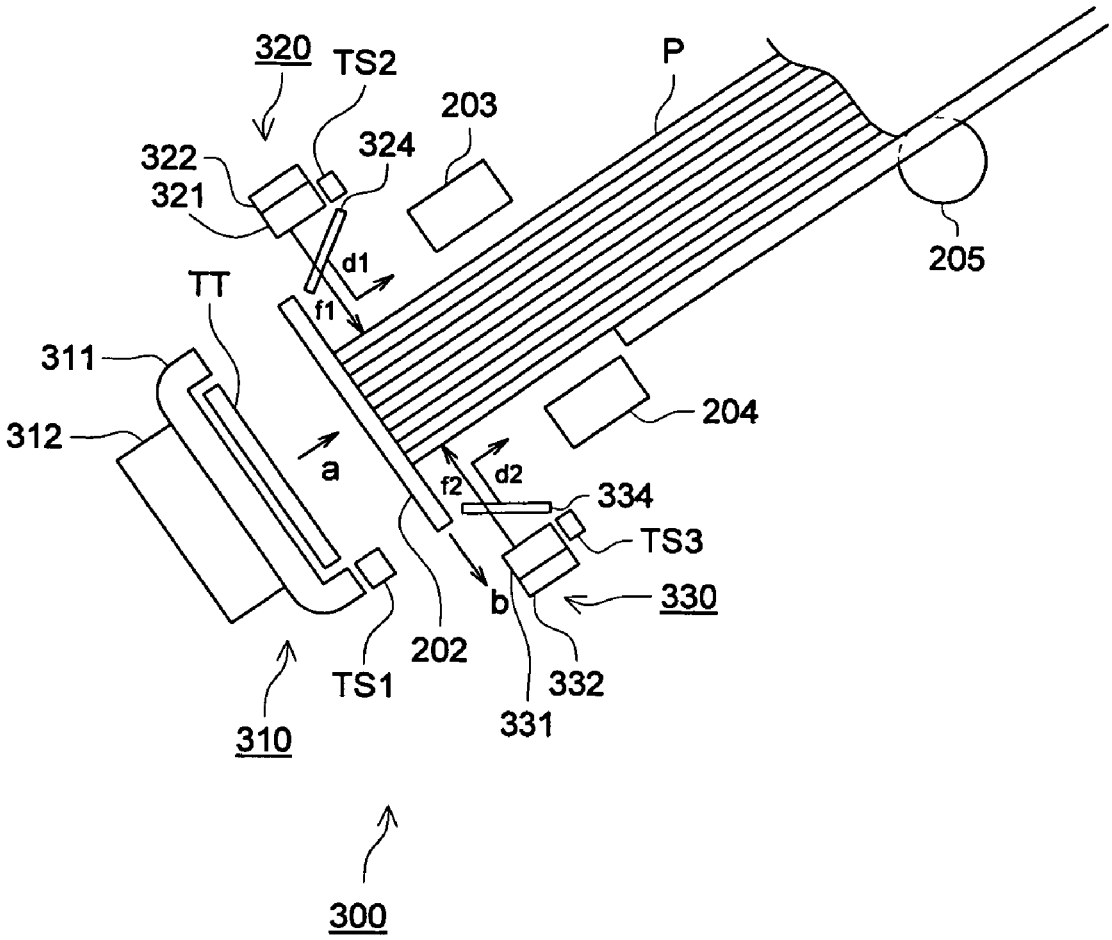
FIG. 2 is a diagram showing schematically the vicinity of the bookbinding unit of a bookbinding device.

FIG. 2 is a schematic diagram showing the vicinity of the bookbinding unit 300 of a bookbinding device B.

The bookbinding unit 300 includes a binding tape TT that is coated with a hot melt type adhesive, a binding tape feeder (not shown in the figure) that cuts the binding tape TT to a predetermined length and sends it from the tape source roll section (not shown in the figure) to a main heating unit 310, the main heating unit 310 that presses the binding tape TT, while heating it from the back, against the front edge surface of the arranged bundle of sheets to be bound, and a side-surface heating unit (a) 320 and side-surface heating unit (b) 330 that press the two side-surfaces of the binding tape TT, while heating, against the top surface and bottom surface of the bundle of sheets, etc.

The main heating unit 310 includes a heating member (a) 311, a heater (a) 312, and a temperature detection unit (a) TS1, wherein the heating member (a) 311 is controlled by the temperature detection unit TS1 and the control unit C2 so that it is maintains a predetermined temperature. In a similar manner, the side-surface heating unit (b) 320 includes a heating member (b) 321, a heater (b) 322, and a temperature detection unit (b) TS2, and a side-surface heating unit (c) 330 includes a heating member (c) 331, a heater (c) 332, and a temperature detection unit (c) TS3, and control is carried out by the control unit C2 so that they are maintained at predetermined temperatures.

When the stacking of the last page on the sheet loading table 201 is completed, the pressure contact members 203 and 204 tightly sandwich the bundle of sheets so that the arrangement of the sheets is not broken, the front edge restricting plate 202 moves, and the front edge of the bundle of sheets butts the bookbinding unit 300 with the binding tape TT placed in between, the main heating unit 310 moves in the direction of arrow 'a' by the heating unit moving unit (not shown in the figure), thereby pressing the binding-tape TT against the front edge of the bundle of sheets. Because of this movement, the adhesive of the binding tape TT melts and is transferred to the front edge of the bundle of sheets.

The binding tape side-surface guides 324 and 334 move in the directions of arrows 'd1' and 'd2', respectively, and bend the side-surfaces of the binding tape towards the topmost surface and the bottommost surface. When the movements of the binding tape side-surface guides 324 and 334 are completed, the side-surface heating unit (b) 320 and the side-surface heating unit (c) 330 move in the directions of arrows 'f1' and 'f2', respectively, and press the bent side-surfaces of the binding tape TT onto the topmost surface and the bottommost surface of the bundle of sheets while heating the tape side edges at the same time, thereby binding the bundle of sheets. The adhesive of the binding tape TT melts due to heating and gets transferred to the side edge surfaces of the bundle of sheets. When a previously set pressing time has elapsed, the main heating unit 310, the side-surface heating unit (b) 320, and the side-surface heating unit (c) 330 return to their original positions and part from the bundle of sheets. With this movement, the temperature of the molten adhesive of the binding tape TT suddenly drops thereby hardening the adhesive, and hence the bundle of sheets gets bound at the front edge surface by the hardened adhesive.

The sheet arranging unit 200 moves to the position shown by dotted lines in FIG. 1 while the bundle of sheets that has been bound being still held at its front end by pressure contact members 203 and 204. Thereafter, the pressure of the pressure contact members 203 and 204 is released, and the bundle of bound sheets is transported to a sheet-bundle loading table 400 by rotating the roller 205 provided in the loading tray 201.

First Embodiment of Warming-Up Control

A first embodiment is equivalent to above stated Item 1-1 and Structure (D) described above, and the control is carried out so that warming-up of the bookbinding device is made after the completion of the warming-up of the image forming device.

Figure 3:
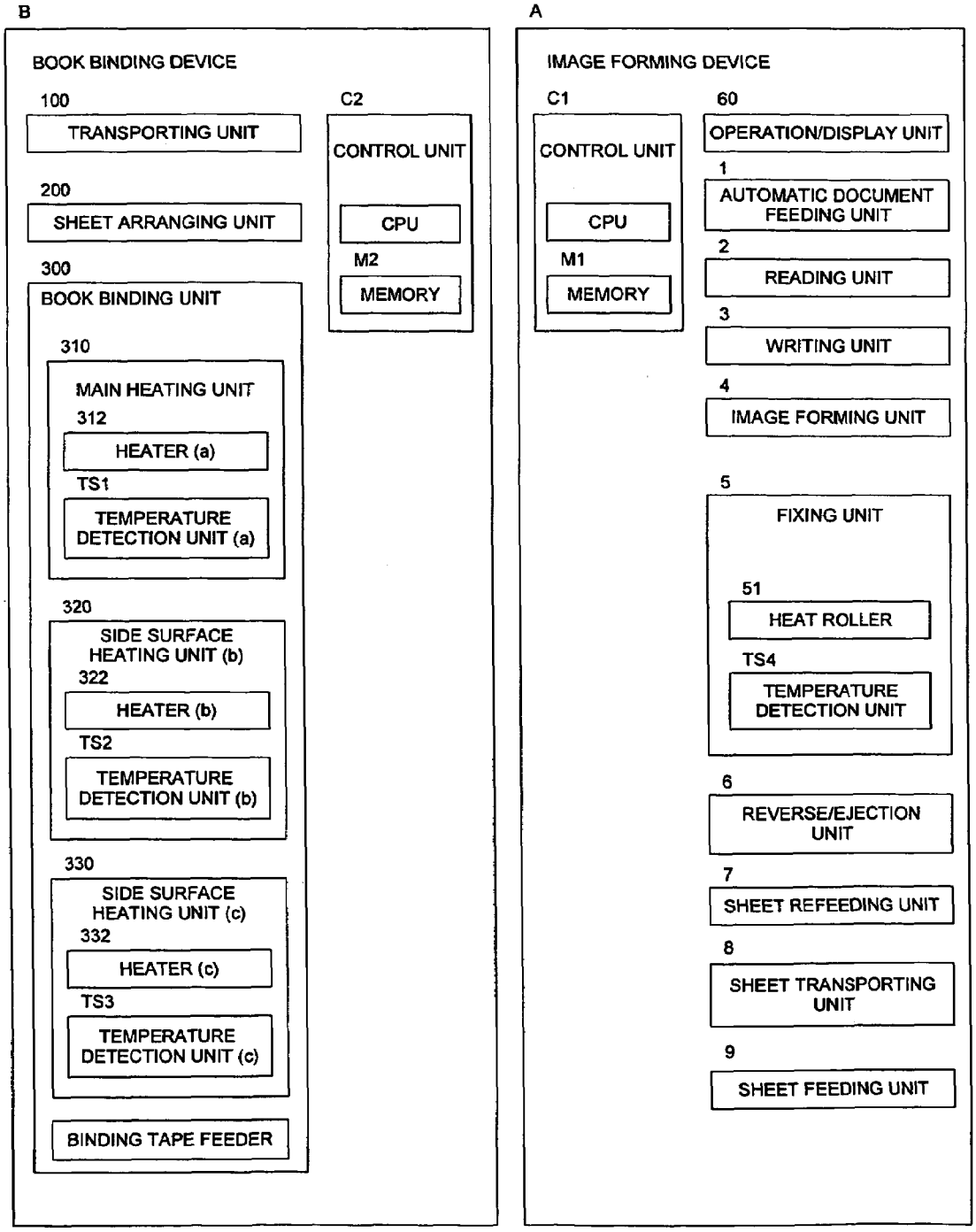
FIG. 3 is a block diagram showing the control relationships of the image forming device and the bookbinding device in a first embodiment of the present invention.

FIG. 3 is a block diagram showing the control relationships of the image forming device A and the bookbinding device B in the first embodiment of the present invention. Parts not directly related to the present embodiment are omitted in the description of this figure.

A control unit C1 of the image forming device is a computer system that includes a CPU, a calculation unit, a memory M1, an input/output interface, a communication unit, and a drive circuit, etc. The control of each of these units is carried out by executing programs that are stored in advance in the memory M1.

The fixing unit 5 of the image forming device includes a heat roller 51 that is heated by a flow of current controlled by the control unit C1, and a temperature detection unit TS4 that detects the temperature of the heat roller 51. The temperature data of the heat roller 51 detected by the temperature detection unit TS4 is transmitted to the control unit C1.

Further, in the description given below, the operation described here is an example of warming-up, which makes the temperature of the heater of the fixing unit of the image forming device reach a predetermined temperature after the power supply has been switched on. However, warming-up operations need not be limited to this, but can also be operations which make the heater of the fixing unit of the image forming device A reach a predetermined temperature after being started from a low consumption power mode such as the power saving mode or the sleep mode. In addition, even in the case of the bookbinding device, in a similar manner, this warming-up can be the operations of making the heater of the fixing unit of the image forming device A reach a predetermined temperature after being started from an energy saving mode. Also, operation of the operation/display unit of the image forming device A, input of a job, or the like becomes the trigger for starting from the low consumption power mode.

The control unit C1 compares the temperature data of the heat roller 51 transmitted from the corresponding temperature detection unit with the predetermined temperature value (threshold value) of the temperature of the heat roller 51 that has been stored in the memory M1 and when the data does not reached the threshold value, it is determined that the temperature of the heat roller 51 has not reached the predetermined temperature, and control is carried out so as to supply power to the heater of the heat roller 51 until it reaches the predetermined temperature, wherein the starting of the warming-up of the bookbinding device B is prohibited until the heat roller 51 reaches the predetermined temperature.

When the temperature data of the heat roller 51 is either equal to the temperature data threshold value or exceeds it, it is determined that the temperature of the heat roller 51 has reached the predetermined temperature. Then, the warming-up of the fixing unit 5 is terminated, and the current supply to the heater of the heat roller 51 is switched to a low power value necessary for maintaining the temperature. In addition, the starting of warming-up of the bookbinding device B is released from prohibition.

When the power supply is switched on by the user, the control unit C1 gives a command to supply power to the heater of the fixing unit and at the same time gives a command of prohibiting warming-up of the bookbinding device B. In addition, the control unit C1 also prohibits operations of jobs input while warming-up is in progress, and instructs the operation/display unit 60 to display a message indicating that warming-up is in progress. Upon receiving the instructions from the control unit C1, the power supply to the heater of the heat roller 51 is started, and a message, for example, "Warming-up is in progress. Please wait . . . " is displayed on the operation/display unit 60. In this state, the image forming device A does not operate even if the user tries to make copies.

During the warming-up of the image forming device A the control unit C1 carries out the following operations based on the temperature data of the heat roller 51 of the image forming device A detected and transmitted from the temperature detection unit TS4.

(1) The warming-up is continued and the determination of the temperature of the heat roller 51 is repeated if the temperature of the heat roller 51 is lower than the predetermined value (threshold value).

(2) When the temperature of the heat roller 51 reaches the predetermined value, or has already reached the predetermined value, the warming-up of the fixing unit 5 is terminated and also the transmission of the command prohibiting warming-up of the bookbinding device is stopped.

Further, a control unit C2 of the bookbinding device is similar in structure to the control unit C1 although smaller in scale, and carries out control so that the warming-up of the bookbinding device is not carried out when the command prohibiting warming-up of the bookbinding device is transmitted, and the warming-up of the bookbinding device is carried out when transmission of the command prohibiting warming-up of the bookbinding device is stopped.

The main heating unit 310 of the bookbinding unit 300 is heated by the heater (a) 312 controlled by the control unit C2 and its temperature is detected by the temperature detection unit (a) TS1. In a similar manner, the side-surface heating unit (b) 320 and the side-surface heating unit (c) 330 are heated by the heater (b) 322 and the heater (c) 332, respectively, and their respective temperatures are detected by the temperature detection unit (b) TS2 and the temperature detection unit (c) TS3.

The temperature data detected by the temperature detection unit (a) TS1, the temperature detection unit (b) TS2, and the temperature detection unit (c) TS3 are transmitted to the control unit C2 of the bookbinding device. The supply of current to these heaters is controlled by the control unit C2.

Figure 5:
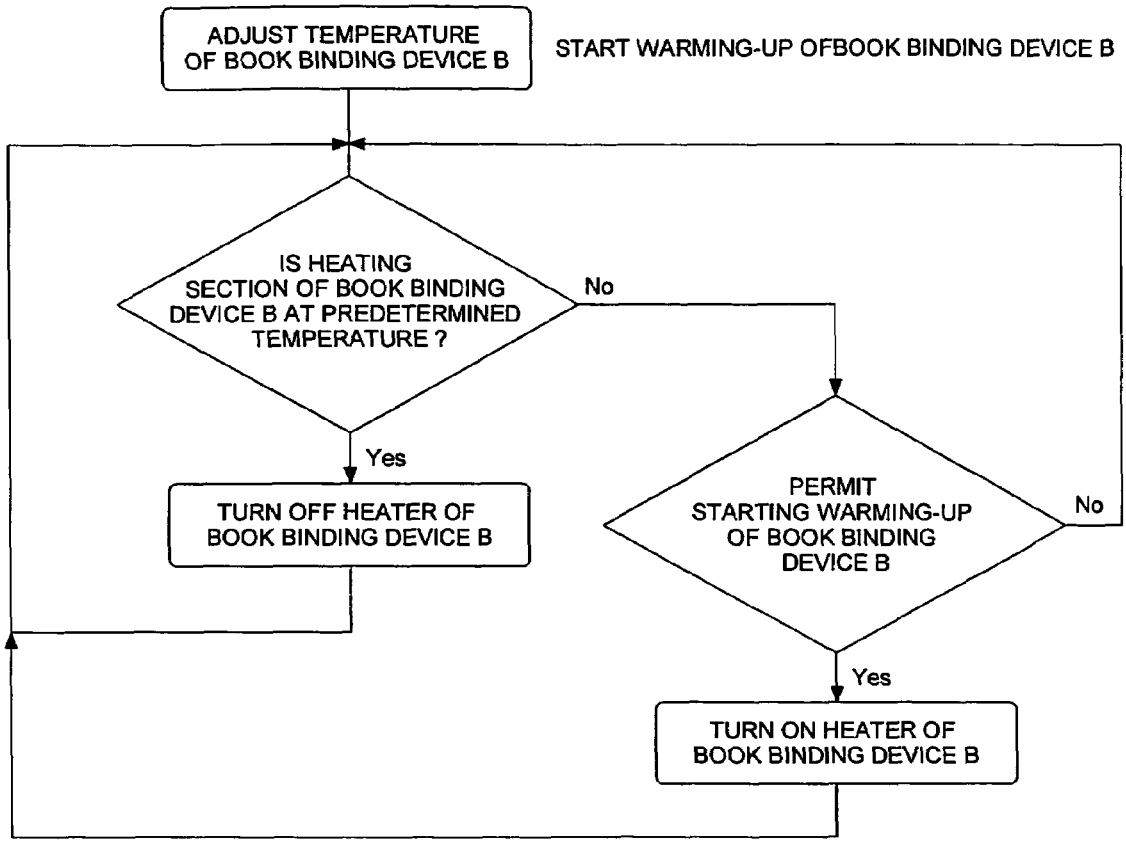
FIG. 5 is a flow chart showing the warming-up temperature control of the bookbinding device in the first embodiment of the invention.

As is shown in FIG. 5, the control unit C2 compares each temperature data detected and transmitted from each temperature detection unit with the respective threshold value that have been stored in the memory M2, and when the transmitted temperature values have not reached the respective threshold values, it is determined that the temperature of the main heating unit 310, the side-surface heating unit (b) 320, and the side-surface heating unit (c) 330 have not reached the predetermined temperature, and when the transmitted temperatures are equal to or higher than the threshold values, it is determined that the temperatures of the main heating unit 310, the side-surface heating unit (b) 320, and the side-surface heating unit (c) 330 have reached the respective predetermined temperatures.

The control unit C2 carries out control so that power is supplied to the heater (a) 312, heater (b) 322, and the heater (c) 332 until the temperatures of the main heating unit 310, the side-surface heating unit (b) 320, and the side-surface heating unit (c) 330 reach the predetermined temperatures, thereby carrying out warming-up of the respective heating members. When the temperatures of the heating units of the bookbinding device are lower than the predetermined temperatures, warming-up of the bookbinding unit is continued. When the temperatures of the heating unit reach the predetermined temperatures or has already reached the predetermined temperatures, the control unit C2 terminates the warming-up of the bookbinding unit and transmits bookbinding unit warming-up completion data, to the control unit C1, indicating that the warming-up of the bookbinding unit is complete.

The control unit C1, upon receiving the bookbinding unit warming-up completion data, permits any job input, and displays, for example, a message such as "Ready to copy" on the operation/display unit 60. In this state, the bookbinding system enables all job inputs and the operations based on the jobs that have been input are enabled.

Figure 4:
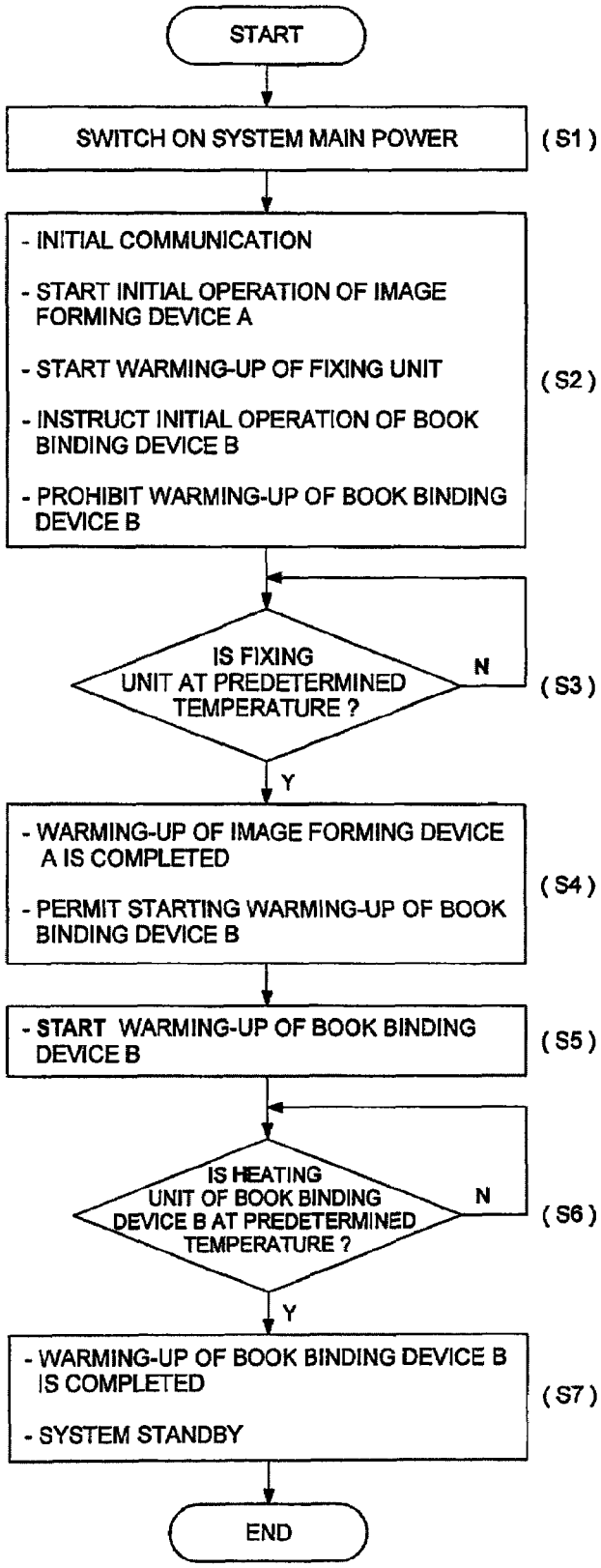
FIG. 4A is a flow chart showing the flow of control of the bookbinding system warming-up in the first embodiment of the invention.
FIG. 4B is a flow chart showing the flow of control of the bookbinding system warming-up in a modified example of the first embodiment of the invention.
Figure 4:
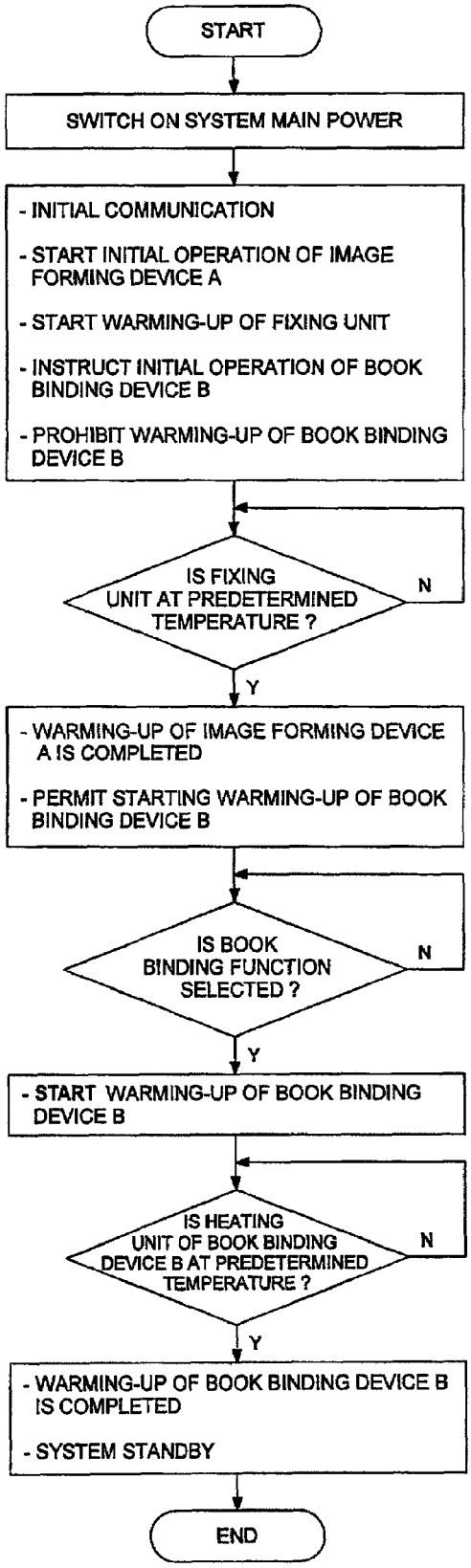

FIG. 4A is a flow chart showing the flow of control of the bookbinding system warming-up in the present embodiment of the invention. At the beginning, the power supply of the bookbinding system is switched on. (Step S1)

When the power supply is switched on, the warming-up of the image forming device is started due to a command from the control unit C1. The control unit C1 prohibits input of any print job and controls the operation/display unit 60 to display a message saying, for example, "Warming-up in progress. Please wait . . . " in. (Step S2)

Herein, the warming-up of the bookbinding device is prohibited due to the bookbinding device warming-up prohibiting command, and in this state, since current is made to flow only through the heater of the heat roller 51 of the fixing unit of the image forming device A and no current is passed through the respective heaters of the bookbinding unit, the bookbinding system is warmed up with lesser power consumption.

The control unit C1 compares the data from the temperature detection unit TS4 that detects the temperature of the heat roller 51 of the fixing unit 5 with a predetermined value, and determines whether or not the warming-up of the fixing unit 5 has been completed. (Step S3)

The control unit C1 determines that the warming-up has not been completed if the temperature data from the temperature detection unit TS4 has not exceeded a predetermined value (Step S3: N), and continues the warming-up of the fixing unit 5 while repeating the determination on whether or not the warming-up has been completed.

When the temperature data from the temperature detection unit TS4 has exceeded a predetermined value (Step S3: Y), the warming-up of the fixing unit has been completed. Therefore, not only the warming-up of the fixing unit is terminated but also the transmission of the bookbinding device warming-up prohibiting command is stopped. (Step S4)

The control unit C2 starts the warming-up of the bookbinding device B when the transmission of the bookbinding device warming-up prohibiting command from the control unit C1 has stopped. (Step S5) In this condition, since the power is supplied mainly to the respective heaters of the bookbinding unit and since only a small power is supplied to the fixing unit 5 in order to maintain the temperature, the bookbinding system is warmed up with a small power consumption.

As to whether or not the warming-up of the bookbinding unit 300 has been completed it is detected based on the data from the temperature detection unit (a) TS1, the temperature detection unit (b) TS2, and the temperature detection unit (c) TS3 which detect the temperatures in the bookbinding unit 300 of the bookbinding device B. (Step S6)

If the data from the temperature detection unit (a) TS1, the temperature detection unit (b) TS2, and the temperature detection unit (c) TS3 do not exceed the predetermined values (Step S6: N), then it is determined that warming-up of the bookbinding unit 300 has not yet been completed, and the warming-up of the fixing unit 5 is continued while repeating the determination on whether or not the warming-up has been completed.

If the data from the temperature detection unit (a) TS1, the temperature detection unit (b) TS2, and the temperature detection unit (c) TS3 exceed the predetermined values, the warming-up of the bookbinding unit 300 has been completed. Accordingly, the warming-up of the bookbinding unit 300 is terminated and the bookbinding unit warming-up completion data is transmitted to the control unit C1 indicating that the warming-up of the bookbinding unit 300 has been completed. (Step S6: Y)

The control unit C1, upon receiving the bookbinding unit warming-up completion data, permits the reception of a job in any mode and also displays on the operation/display unit 60 a message, for example, "Ready to copy". (Step S7)

A Modified Example of the First Embodiment of Warming-Up Control

In the first embodiment described above, when the warming-up of the fixing unit 5 is completed, the transmission of the bookbinding device warming-up prohibiting command is stopped and the warming-up of the bookbinding device B is started. However, it is also possible not to start the warming-up of the bookbinding device B upon completion of the warming-up of the fixing unit 6 but, as a modified example of the above first embodiment, as is shown in FIG. 4B, wherein, after the warming-up of the fixing unit 5 has been completed, the warming-up of the bookbinding device B can be started at the time when it is determined that the bookbinding function is selected by a job that has been input. Although no mode is set in this modified example, since all other operations are almost the same as in the case where Mode 2 has been selected in a second embodiment described later, further descriptions of this example are omitted here.

As described above, in a bookbinding system structured by connecting a bookbinding device having a bookbinding unit, which includes a heating unit to melt the adhesive of a binding tape, to an image forming device having a fixing unit that fixes images on sheets by heating, it is possible to reduce the maximum power consumption of the bookbinding system with a simple structure by carrying out control using a control unit so that only the image forming device is warmed up after switching on the power supply and the bookbinding device is warmed up after completion of the warming-up of the image forming device.

Further, although an example of a bookbinding device using a binding tape in a bookbinding system has been described here, the present invention is not limited to this, and is applicable to any bookbinding system that is based on combination of various type of bookbinding device having a heating unit and an image forming device.

Second Embodiment of Warming-Up Control

The second embodiment corresponds to Item 2-1, structure (B), and structure (C), wherein warming-up is controlled, according to the first mode or the second mode.

Figure 6:
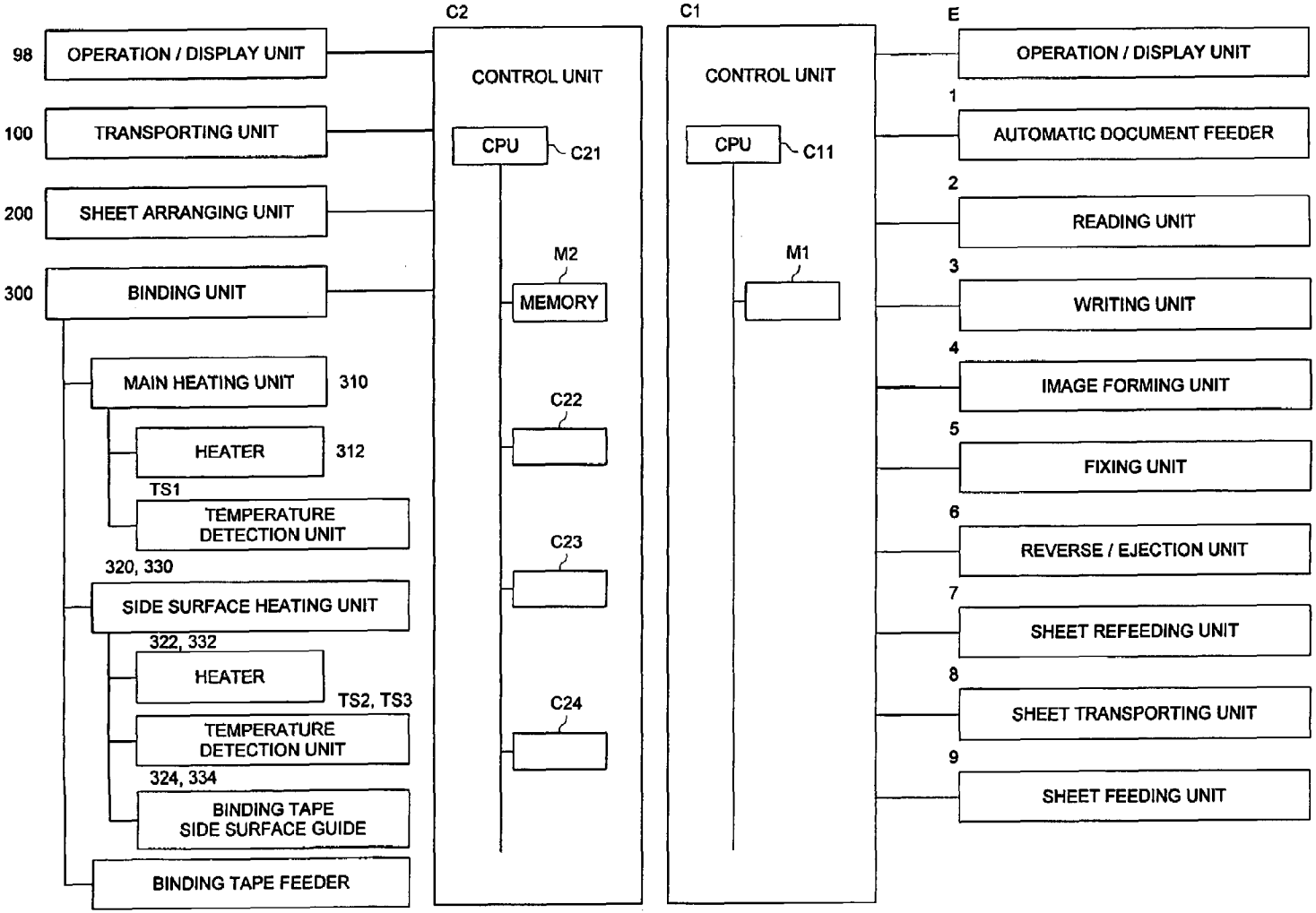
FIG. 6 is a block diagram showing the control relationships of the image forming system in a second embodiment of the invention.

FIG. 6 is a block diagram showing the control relationships of an image forming system 20 including an image forming device A and a bookbinding device B in a second embodiment of the invention.

In the second embodiment, a control unit C2 has the functions of a power-supply-switch-on detection unit C22 as the first trigger detection unit, a bookbinding-job detection unit C23 as the second trigger detection unit, and a warming-up control unit C24.

The power-supply-switch-on detection unit C22 directly detects that the power supply has been switched on to the bookbinding device B via an operation/display unit E of an image forming device A or via a power supply switch, not shown in the figure, or indirectly detects by detecting a signal which is output from a control unit C1 that has detected that the power supply has been switched on.

A bookbinding job detection unit C23 detects setting data for performing bookbinding operations, the data having being transmitted from the operation/display unit E of the image forming device A and stored in the memory M2. In addition, when the image forming device A carries out image formation based on a print job transmitted from a computer, not shown in the figure, the control unit C1 detects setting data, for performing bookbinding operations, included in the print job stored in the memory M1 and transmits the setting data. The setting data is then stored in the memory M2, and the bookbinding job detection unit C23 detects the setting data for performing bookbinding operations stored in the memory M2.

The warming-up control unit C24 carries out control so that the temperatures of a main heating unit 310 and side-surface heating units 320 and 330 are raised to predetermined temperatures by controlling a heater 312 of the main heating unit 310 and heaters 322 and 332 of the side-surface heating units 320 and 330, based on the temperatures detected by the temperature detection unit TS1, TS2, and TS3.

The setting of the warming-up modes is described below.

The warming-up mode of the bookbinding device B can be selected from two modes. One of the modes (referred to as Mode 1) is a mode in which the warming-up of the bookbinding device B starts as soon as the power supply to the bookbinding device B is switched on and maintaining the main heating unit 310 and the side-surface heating units 320 and 330 always at predetermined temperatures so that they are always capable of carrying out bookbinding operations, and the other mode (referred to as Mode 2) is a mode in which the warming-up of a post-processor is started when there is post-processing setting in a waiting job.

Figure 7:
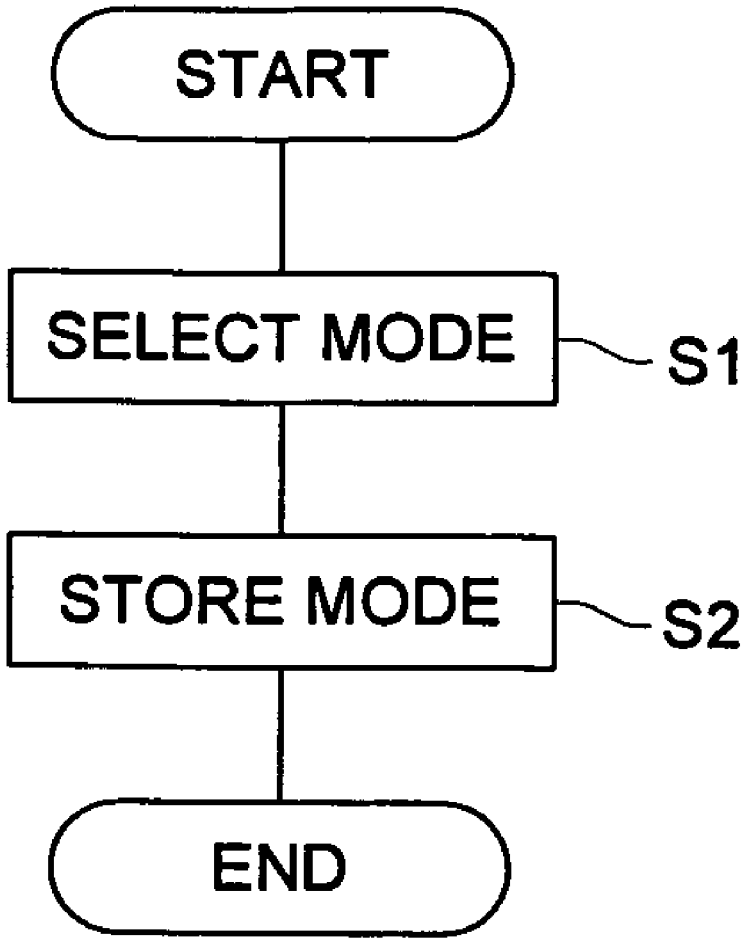
FIG. 7 is a flow chart showing the flow of the warming-up setting processing in the image forming system according to the second embodiment.

FIG. 7 is a flow chart showing the flow of the warming-up mode setting operations in the bookbinding device B, according to the present embodiment.

The selection of the warming-up mode is made in Step S1. The warming-up mode is selected after the power supply is switched on to the bookbinding device B via an operation/display unit 98 as is described later in FIG. 6.

In Step S2, the selected mode is stored in a predetermined area of the memory M2, and then the processing is terminated.

Figure 8:
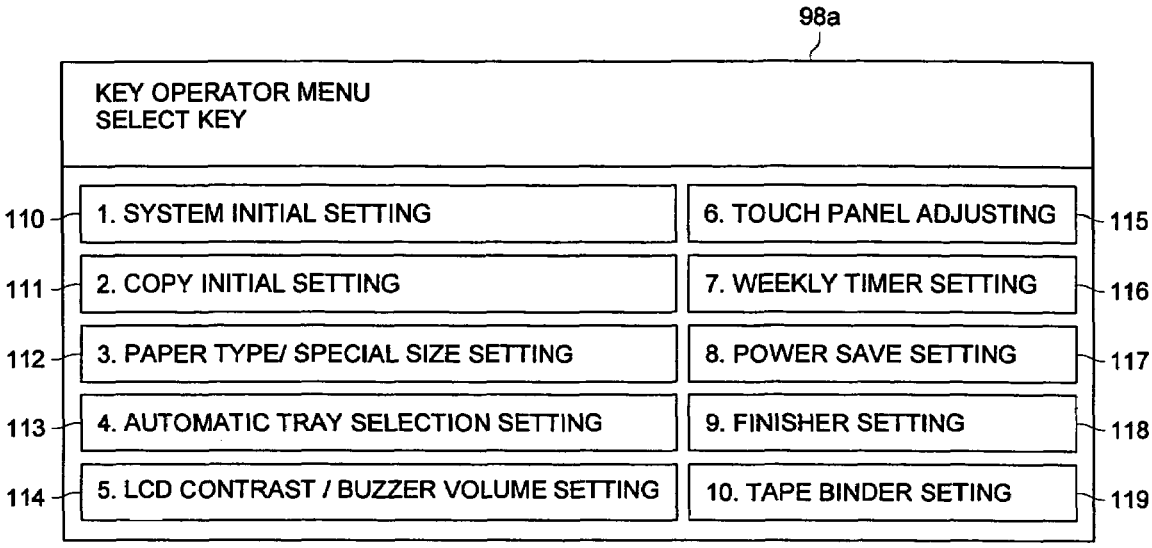
FIG. 8A is an example of a menu screen associated with the flow chart of FIG. 7.
FIG. 8B is an example of a mode setting screen associated with the flow chart in FIG. 7.
Figure 8:
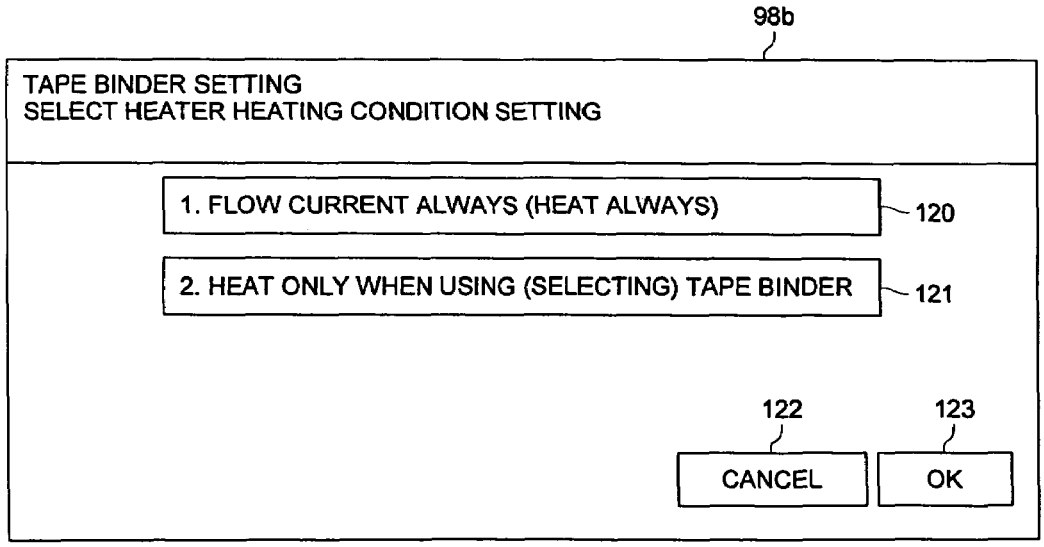

The procedure of setting the warming-up mode is described referring to FIGS. 8A and 8B.

Immediately after the power supply of the bookbinding device B is switched on, a menu screen 98*a*, as shown in FIG. 8A, is displayed on the operation/display unit 98 of the bookbinding device B, and various types of input buttons 110 through 119 are displayed on a menu screen 98*a*.

When a tape binder setting button 119 is pressed, the display on the operation/display unit 98 changes to be a settings screen 98*b* shown in FIG. 8B.

An input button 120 in the settings screen 98*b* is a button for selecting Mode 1, an input button 121 is a button for selecting Mode 2, an input button 122 is a button for canceling a mode selection, and an input button 123 is a button for confirming a mode selection.

In other words, in the state in which the setting screen 98*b* is displayed, if the input button 123 is pressed after the input button 120 or the input button 121 is pressed, the selected mode is confirmed and the display returns to the menu screen of 98*a*. If the input button 122 is pressed after the input button 120 or the input button 121 is pressed, the mode setting is not made and the display returns to the menu screen of 98*a*.

Mode 1 is automatically selected as the warming-up mode for the initial condition immediately after the power supply to the bookbinding device B is switched on.

The operation of the bookbinding device B will be described here, referring to FIGS. 9A and 10.

Figure 9:
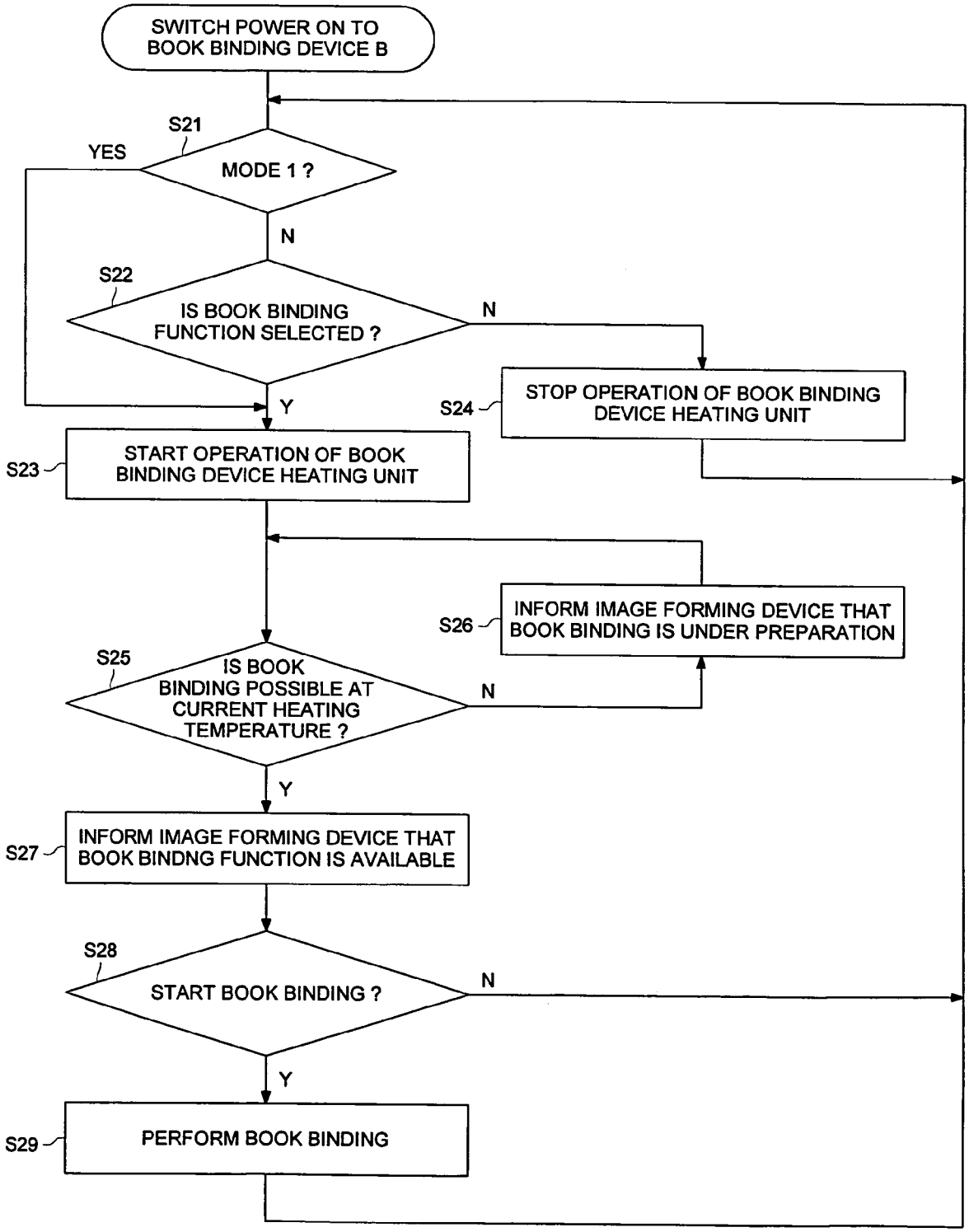
FIG. 9A is a flow chart showing the flow from warming-up to post-processing in a bookbinding device in the second embodiment of the invention.
FIG. 9B is a flow chart showing the flow from warming-up to post-processing operations in a bookbinding device in a modified example of the second embodiment of the invention.
Figure 10:
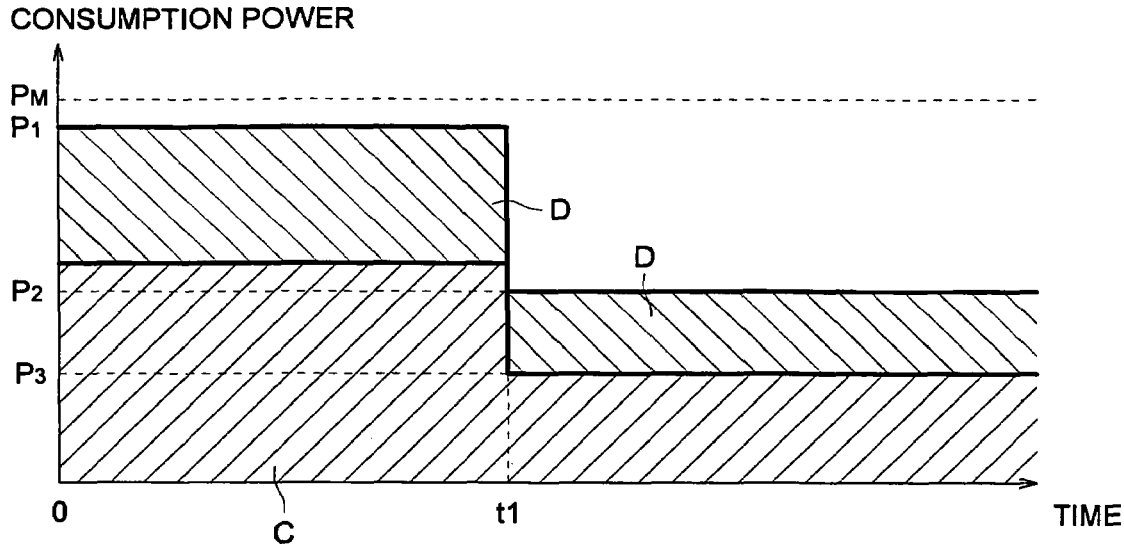
FIG. 10A is a graph showing the change with time of the power consumption of the image forming system in Mode 1 in the second embodiment.
FIG. 10B is a graph showing the change with time of the power consumption of the image forming system in Mode 2 in the second embodiment.
Figure 10:
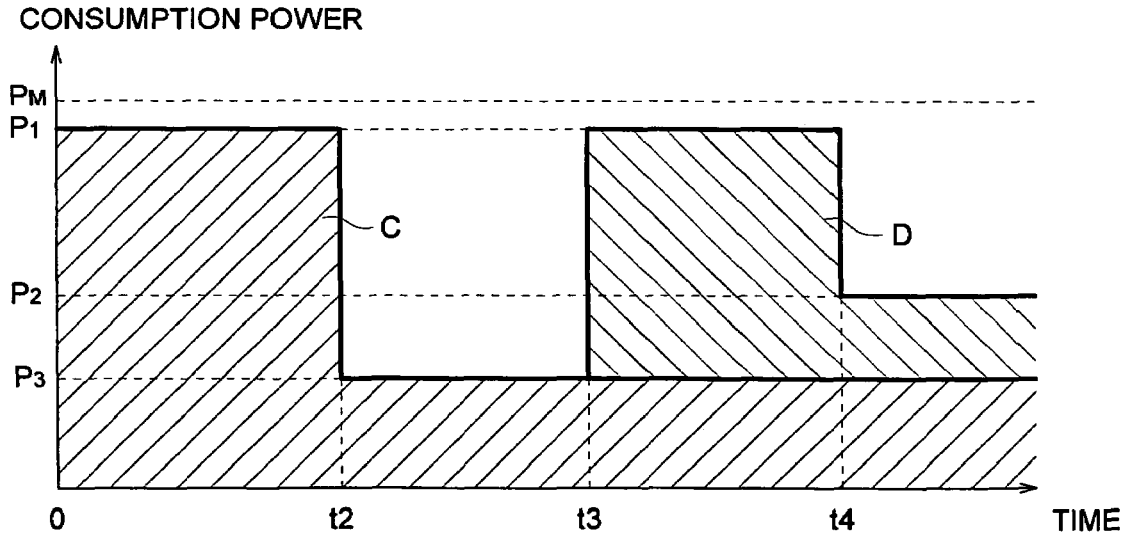

FIG. 9A is a flow chart showing the flow of operations in the bookbinding device B.

In Step S21, a warming-up mode set during the processing described in FIG. 7 is determined. The mode data stored in a predetermined area of the memory M2 is referred to, and if the selected mode is Mode 1 (Step S21: YES), then the processing of Step S23 is executed, and the processing of the Step S22 is executed if the selected mode is not Mode 1, that is, if the selected mode is Mode 2 (Step S21: NO).

In Step S22, the determination is made as to whether or not the bookbinding function has been set. Setting data, for carrying out bookbinding operations, stored in a predetermined area of the memory M2 is referred to, and if the bookbinding function has been set (Step S22: YES) the processing of Step S23 is executed, and the processing of Step S24 is executed if bookbinding function has not been set (Step S22: NO).

In Step S23, the heating operations of the heaters 312, 322, and 332 are started.

In Step S24, the heating operations of the heaters 312, 322, and 332 are stopped.

In Step S25, a determination is made as to whether the heating temperatures of the main heating unit 310 and the side-surface heating units 320 and 330 have reached the temperatures at which bookbinding is possible. This determination is made by referring to the temperature detection unit TS1 of the main heating unit 310 and the respective temperature detection units TS2 and TS3 of the side-surface heating units 320 and 330. If the heating temperatures of the main heating unit 310 and the side-surface heating units 320 and 330 have reached the temperatures at which bookbinding is possible, Step S27 is executed, and if not, Step S26 is executed.

In Step S26, the fact that the bookbinding function is not ready is informed to the image forming device A using a communication unit, not shown in the figure.

In Step S27, the fact that the bookbinding function is ready is informed to the image forming device A using a communication unit, not shown in the figure.

In Step S28, a determination is made as to whether or not the bookbinding function has been set. This determination is made by referring to the data stored in a predetermined area of the memory M2. If it is determined that the bookbinding function has been set (Step S28: YES), the processing of Step S29 is executed, and the processing of Step S21 is executed if it is not determined that bookbinding function has been set (Step S28: NO).

The bookbinding operations are carried out in Step S29.

Next, the variation with time of the power consumption of the image forming system 20 in the present embodiment will be described here, referring to FIG. 10.

FIGS. 10A and 10B are diagrams showing the relationship of the power consumption to time with the vertical axis representing the power consumption and the horizontal axis representing the elapsed time. The graph in FIG. 10A is for Mode 1 and the graph in FIG. 10B is for Mode 2. Further, in order to simplify the illustration in FIGS. 10A and 10B only the power consumptions of the heaters that are directly related to warming-up are shown. $P_M$ is a maximum power allowed as the power supply source, and $P_1$ is the power used for warming-up the image forming system 20 of the present embodiment. $P_1$ is set to have a suitable margin with respect to $P_M$. $P_2$ is the standby power consumption when the image forming system 20 is in the usable state after the warming-up of the image forming device A and the warming-up of the bookbinding device B have been completed. $P_3$ is the standby power consumption of the image forming system 20 when the warming-up of only the image forming device A has been completed and no current is being supplied to the main heating unit 310, the side-surface heating unit 320, or the side-surface heating unit 330 of the bookbinding device B. The region C indicates the power consumption of the image forming device A and the region D indicates the power consumption of the bookbinding device B.

Referring to FIG. 10A (Mode 1), the time '0' is the moment when the power supply to the bookbinding device B is switched on in the flow chart of FIG. 9A, and the processing of Step S23 is executed after branching to YES in Step S21. Herein, since warming-up mode is Mode 1, the warming-up of the image forming device A and the warming-up of the bookbinding device B are started simultaneously. Herein, the power consumption $P_1$ that is close to the power supply capacity of the power source $P_M$ is used in order to complete the warming-up in a shortest possible time. Further, t1 is the instant of time at which warming-up is completed, and thereafter the power consumption decreases to $P_2$.

Referring to FIG. 10B (Mode 2), the time '0' is the moment when the power supply to the bookbinding device B is switched on in the flow chart of FIG. 9A. Herein, the bookbinding device B is in the loop of branching to NO in Step S21 of the flow chart, branching to NO in Step S22, executing the processing in Step S24, and returning to Step S21. The time from time 0 to time t2 is the warming-up period of the image forming device A, and a power consumption value of $P_1$ that is close to the power supply capacity of the power source $P_M$ is used in order to complete the warming-up in a shortest possible time. At t2, the warming-up of the image forming device A is completed and the power consumption decreases to the standby power $P_3$ of the image forming device A.

The moment of time t3 is the point in the flow chart of FIG. 9A when a branch has been made to YES in Step S22 after determination that the bookbinding function setting is present, and the processing of Step S23 is executed. At this point of time, the power supply is switched on to the heater 312 of the main heating unit 310 and the heaters 322 and 332 of the side-surface heating units 320 and 330 of the bookbinding device B, thereby starting its warming-up. Further, a power consumption value of $P_1$ that is close to the power supply capacity of the power source $P_M$ is used in order to complete the warming-up in a shortest possible time.

The moment of time t4 is the point of time when the warming-up of the bookbinding device B is completed, and the power consumption decreases to the standby power $P_2$ of the image forming system 20.

As has been described above, when Mode 2 is selected as the warming-up mode, since only the warming-up of the image forming device A is carried out immediately after switching on the power, it is possible to use a relatively large power for warming-up of the image forming device A compared to Mode 1, and hence the warming-up is completed in a shorter time than in Mode 1.

Further, comparing the standby power consumption, although the power $P_2$ is being consumed in Mode 1, the standby power is $P_3$ in Mode 2 until the bookbinding function is selected. Therefore, it is possible to have a lower standby power than during Mode 1.

When the bookbinding function is selected in Mode 2, the warming-up of the image forming device A has already been completed and the total usable power can be utilized only for warming-up the bookbinding device B. Therefore, it is possible to complete the warming in a relatively short period of time, thereby making the stress on the operator low.

Figure 11:
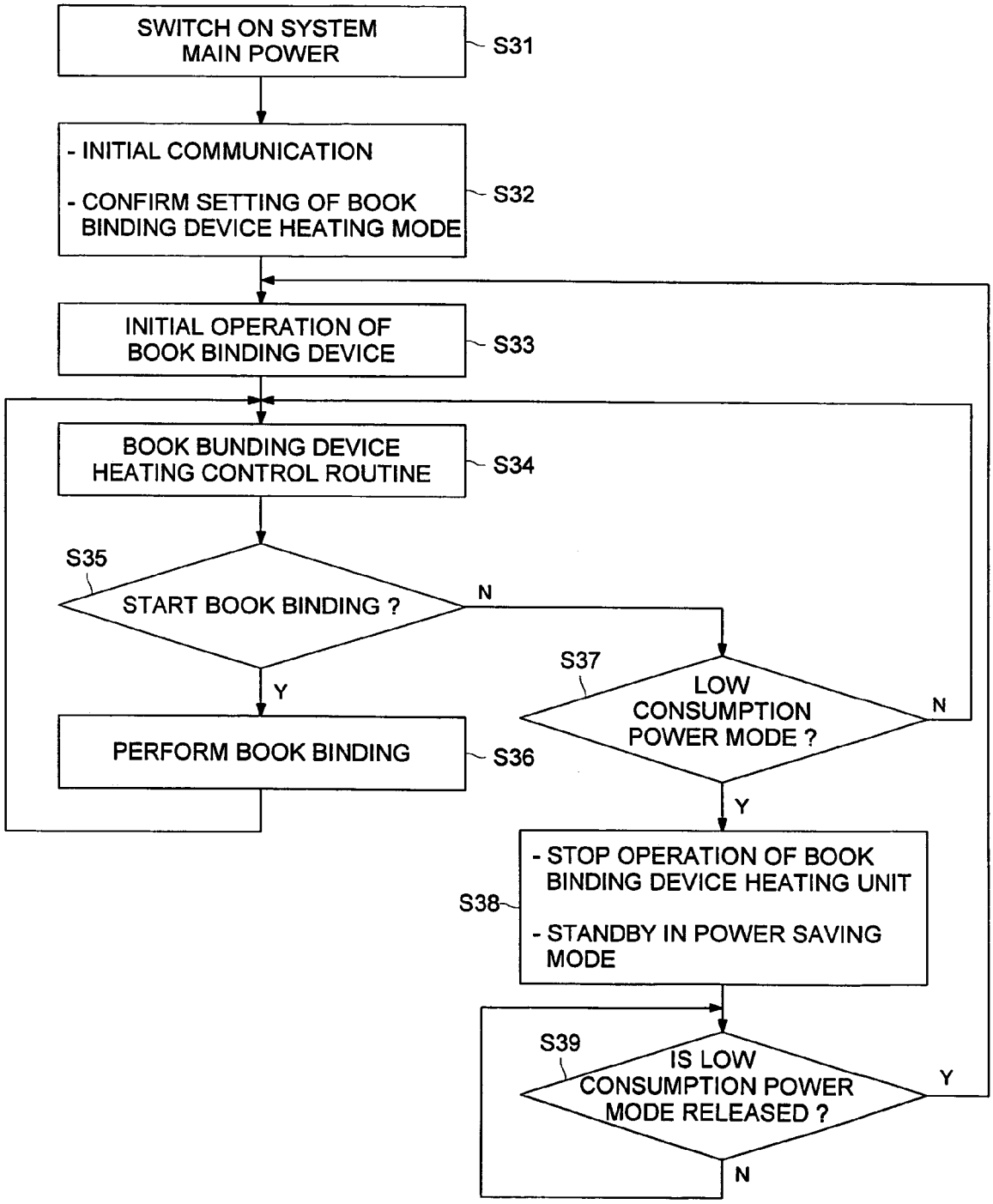
FIG. 11 is a flow chart of an embodiment having a low consumption-power mode mode.

However, during the standby period after executing the bookbinding function until the next bookbinding function is executed, it is desirable that the heating unit of the bookbinding device is put in a low consumption power mode thereby reducing the power consumption to a low value. The flow chart of this low consumption power mode is shown in FIG. 11.

When the system power supply is switched on (Step S31), initial communication and confirmation of setting the heating mode of the bookbinding device are made (Step S32), and after executing the initial operations of the bookbinding device (Step S33), the processing enters the bookbinding device heating control routine (Step S34). Upon returning to the main routine, in (Step S35), the determination is made as to whether or not to start the bookbinding operations, and if the bookbinding is to be started, the bookbinding process is executed (Step S36). After the bookbinding process is completed, the processing returns to the bookbinding device heating control routine (Step S34). If it is determined in Step S35 that the bookbinding is not to be started, the determination is made (Step S37) as to whether or not the low consumption power mode has been set. If the low consumption power mode has been set, the operation of the bookbinding device heating unit is stopped, and after controlling the bookbinding device in the a low consumption power mode (Step. S38), determination is made as to whether or not the low consumption power mode has been released (Step S39). If it has been released, the processing returns to Step S33, carries out the initial operations of the bookbinding device (Step S33), and enters the loop. In Step S39, if it is determined that the low consumption power mode has not been released, the low consumption power mode is maintained. In Step S37, if it is determined that the low consumption power mode is not set, the processing returns to the bookbinding device heating control routine (Step S34).

Modified Example of the Second Embodiment of Warming-Up Control

In the second embodiment described above, in Mode 2, the post-processing data was taken as the second warming-up start trigger, that is, the warming-up of the post-processor was started when a waiting job includes post-processing setting. As a modified example of the second embodiment, it is also possible to take the completion of warming-up of the fixing unit of the image forming device as the second warming-up start trigger in Mode 2, that is, as is shown in FIG. 9B, it is possible to start the warming-up of the post-processor at the completion of the warming-up of the fixing unit.

Third Embodiment of Warming-Up Control

A third embodiment corresponds to Item 3-1 and Structure (A), and the warming-up is controlled based on the result of determination made in the job determination unit.

Figure 12:
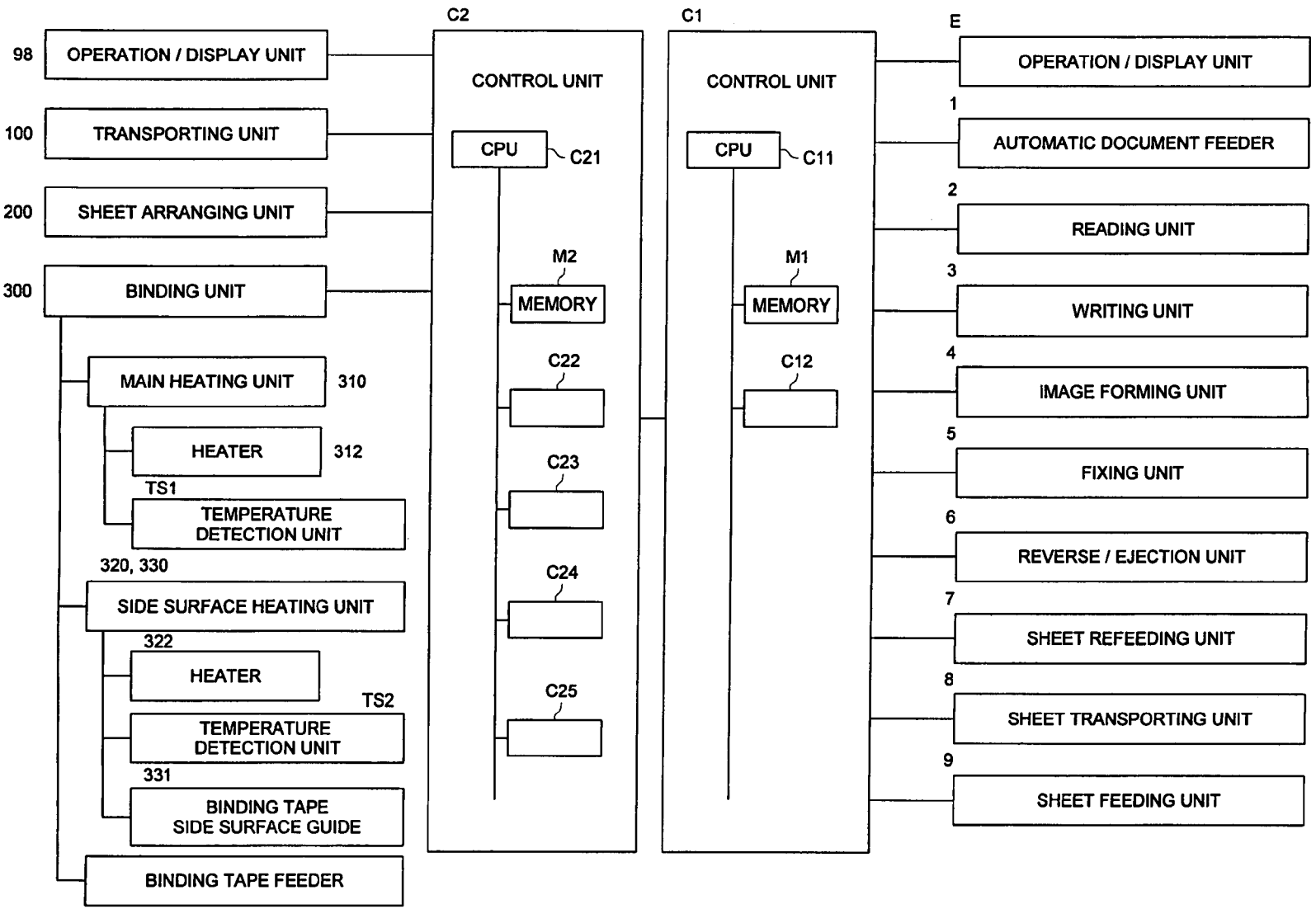
FIG. 12 is a block diagram showing the control relationships of the image forming system in the third embodiment of the invention.

FIG. 12 is a block diagram showing the control relationships in an image forming system 30 including an image forming device A and a bookbinding device B in the third embodiment.

In the third embodiment, while a control unit C1 has the function of a print job determination unit C12, a control unit C2 has the functions of a power-supply-switch-on detection unit C22 as a first trigger detection unit, a bookbinding execution detection unit C23 as a second trigger detection unit, a heating temperature control unit C24, and a heating-unit-preparation detection unit C25.

The print job determination unit C12 refers to a memory M1 which is a print job storage unit, inspects one or more print jobs stored therein, and if post-processing data is included in any print job, then transmits heating-unit-preparation data to the control unit C2 of the bookbinding device B. If post-processing data is included in the job to be executed first, the print job determination unit transmits the data of execution of bookbinding to the control unit C2. The control unit C2 of the bookbinding device B, upon receiving the heating-unit-preparation data or the data for execution of bookbinding, stores the data in a predetermined area of the memory M2.

The power-supply-switch-on detection unit C22 directly detects that the power supply has been switched on to the bookbinding device B via an operation/display unit E of an image forming device A or via a power supply switch, not shown in the figure, or indirectly detects by detecting a signal which is output from a control unit C1 that has detected that the power supply has been switched on.

The bookbinding execution detection unit C23 detects setting data for carrying out bookbinding operations transmitted from the print job determination unit C12 of the image forming device A and stored in the memory M2.

The heating temperature control unit C24 carries out control so that the temperatures of the main heating unit 310 and the side-surface heating units 320 and 330 are raised to predetermined temperatures by controlling the heater 312 of the main heating unit 310, and the heaters 322 and 332 of the side-surface heating units 320 and 330 based on the temperatures detected by the temperature detection units TS1, TS2, and TS3.

The heating-unit-preparation detection unit C25 detects the heating-unit-preparation data transmitted from the print job determination unit C12 of the image forming device A and stored in the memory M2.

Setting of the warming-up mode will be described here.

The warming-up mode of the bookbinding device B can be selected from two modes. One of the modes (referred to as Mode 1) is a mode which starts the warming-up of the bookbinding device B as soon as the power supply to the device is switched on and maintains the main heating unit 310 and the side-surface heating units 320 and 330 always at predetermined temperatures (referred to as the first temperature in the present embodiment) so that they are always capable of carrying out bookbinding operations. The other mode (referred to as Mode 2) is a mode which starts the warming-up of the post-processor if there is setting of post-processing in a waiting job and controls the temperature of the heating unit to be at a first temperature, and, if there is no waiting job, or no post-processing data even when there is a waiting print job, Mode 2 carries out control of the temperature of the heating unit to be at a temperature (referred to as the second temperature in the present embodiment) that is higher than the room temperature and lower than the first temperature. This warming-up mode is set, according to the flow chart of FIG. 7 and via the operation/display unit in FIGS. 8A and 8B described above.

Figure 13:
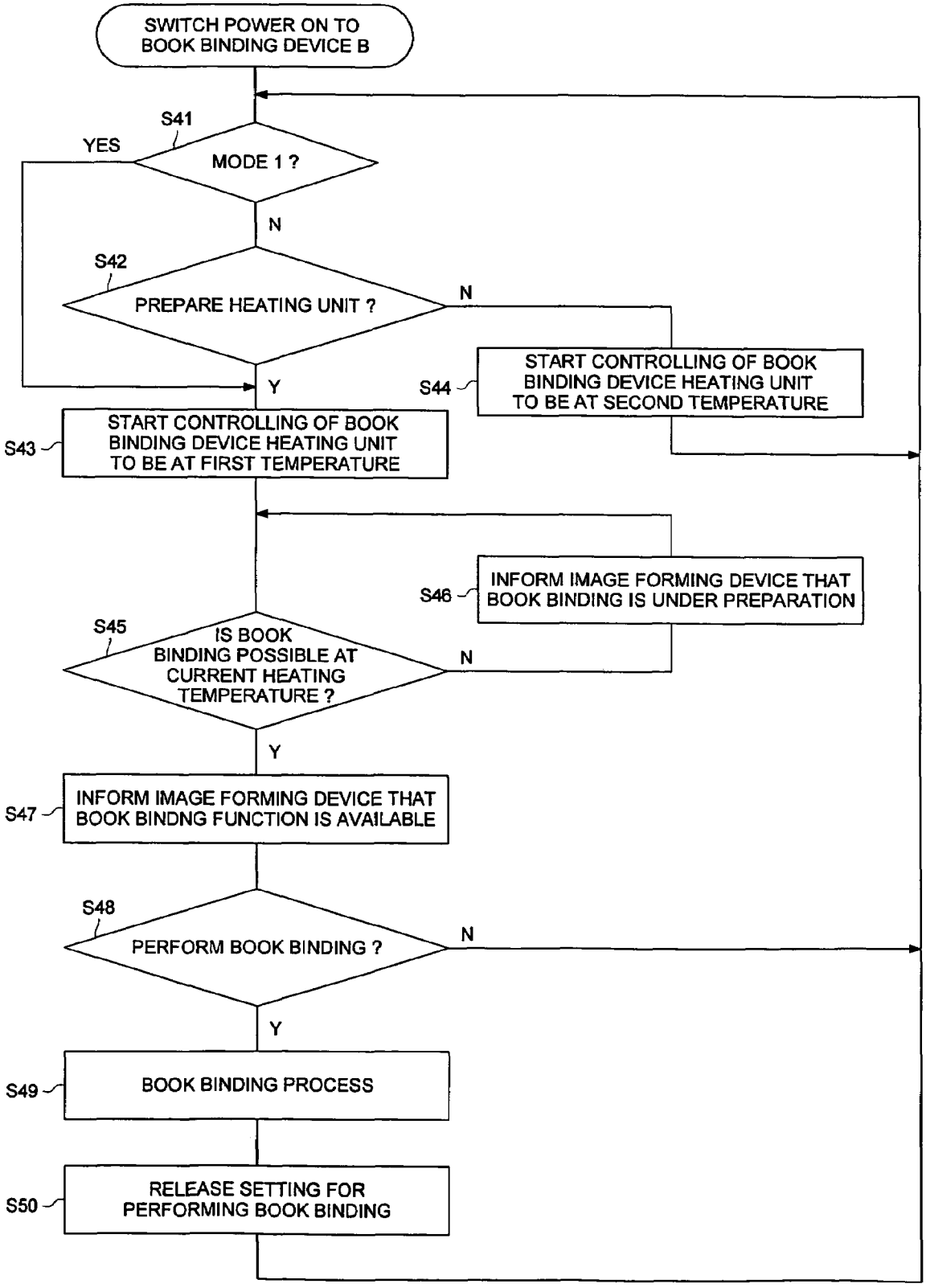
FIG. 13 is a flow chart showing the flow from warming-up to post-processing in a bookbinding device in the third embodiment.

FIG. 13 is a flow chart showing the flow of operations of bookbinding device B.

In Step S41, the warming-up mode having been set during the processing described in FIG. 7 is determined. The mode data stored in the predetermined area of the memory M2 is referred to, and if the selected mode is Mode 1 (Step S41: YES), the processing of Step S43 is executed, and the processing of the Step S42 is executed if the selected mode is not Mode 1, that is, if the selected mode is Mode 2 (Step S41: NO).

In Step S42, determination is made as to whether or not the heating-unit-preparation data has been set. This determination is made by a heating-unit-preparation detection unit C25, referring to the data stored in the predetermined area of the memory M2. Here, as has been described earlier, if post-processing data is included in any print job, the print job determination unit C12 sets the heating-unit-preparation data in the predetermined area in the memory M2. If the heating unit preparation data has been set (Step S42: YES), the processing of Step S43 is executed, and the processing of Step S44 is executed if the heating unit preparation data has not been set (Step S42: NO).

In Step S43, the control towards the first temperature is carried out on the main heating unit 310 and the side-surface heating units 320 and 330.

In Step S44, the control towards the second temperature is carried out on the main heating unit 310 and the side-surface heating units 320 and 330.

In Step S45, a determination is made as to whether the heating temperatures of the main heating unit 310 and the side-surface heating units 320 and 330 have reached the temperatures at which bookbinding is possible. This determination is made by referring to the temperatures according to the temperature detection unit TS1 of the main heating unit 310 and the temperature detection units TS2 and TS3 of the side-surface heating units 320 and 330. If the heating temperatures of the main heating unit 310 and the side-surface heating units 320 and 330 have reached the temperatures at which bookbinding is possible, Step S47 is executed, and if not, Step S46 is executed.

In Step S46, the fact that the bookbinding function is not ready is informed to the image forming device A, using a communication unit, not shown in the figure.

In Step S47, the fact that the bookbinding function is ready is informed to the image forming device A, using a communication unit, not shown in the figure.

In Step S48, a determination is made as to whether or not the bookbinding function is set. This determination is made in such a manner that the bookbinding execution detection unit C23 refers to the data stored in the predetermined area of the memory M2. If it is determined that the bookbinding execution data is set (Step S48: YES), the processing of Step S49 is executed, and the processing of Step S41 is executed if it is not determined that bookbinding execution data is set (Step S48: NO).

The bookbinding operations are carried out in Step S49.

In Step S50, the settings of the bookbinding execution data and the heating-unit-preparation data stored in the predetermined areas of the memory M2 are released.

As described above, in Mode 2, the heating-unit-preparation data stored in the predetermined area in memory M2 is referred to, and the control of the heating units is carried out towards the first temperature if the heating-unit-preparation data is set, and towards the second temperature if the heating unit preparation data is not set. Here, the heating-unit-preparation data stored in the memory M2 is set, according to the heating-unit-preparation data transmitted from the print job determination unit C12 of the image forming device A. In other words, the heating temperature control unit C24 carries out control of the temperature of the heating units, based on the result of determination by the print job determination unit C12.

Next, the variation with time of the power consumption of the image forming system 20 according to the present embodiment will be described here, referring to FIGS. 14A and 14B.

Figure 14:
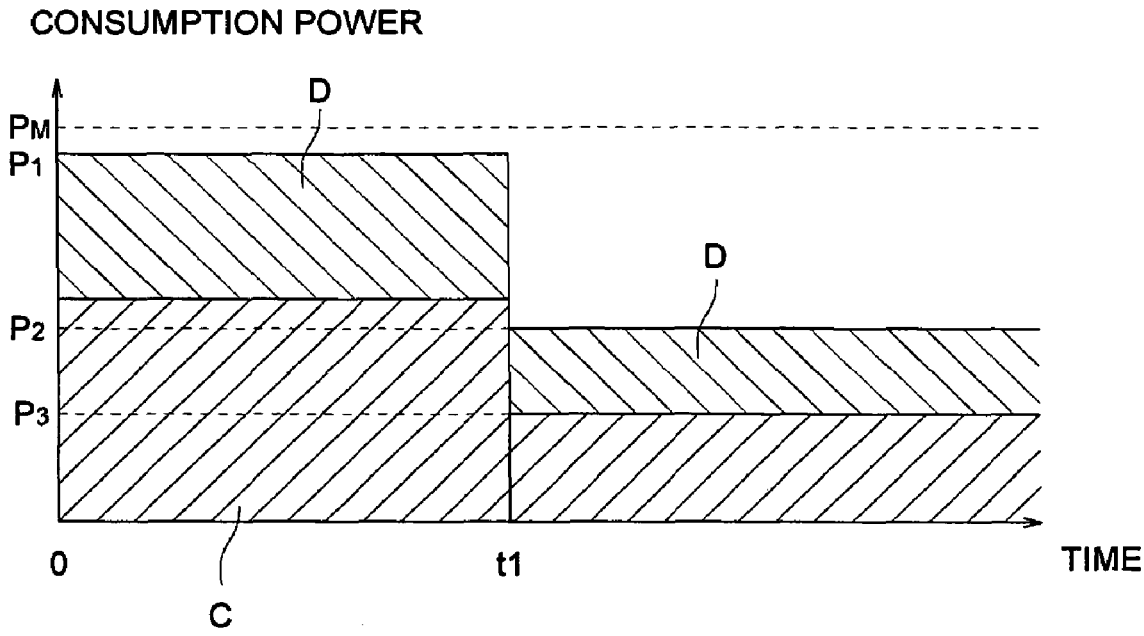
FIG. 14A is a graph showing the change with time of the power consumption of the image forming system in Mode 1 in the third embodiment.
FIG. 14B is a graph showing the change with time of the power consumption of the image forming system in Mode 2 in the third embodiment.
Figure 14:
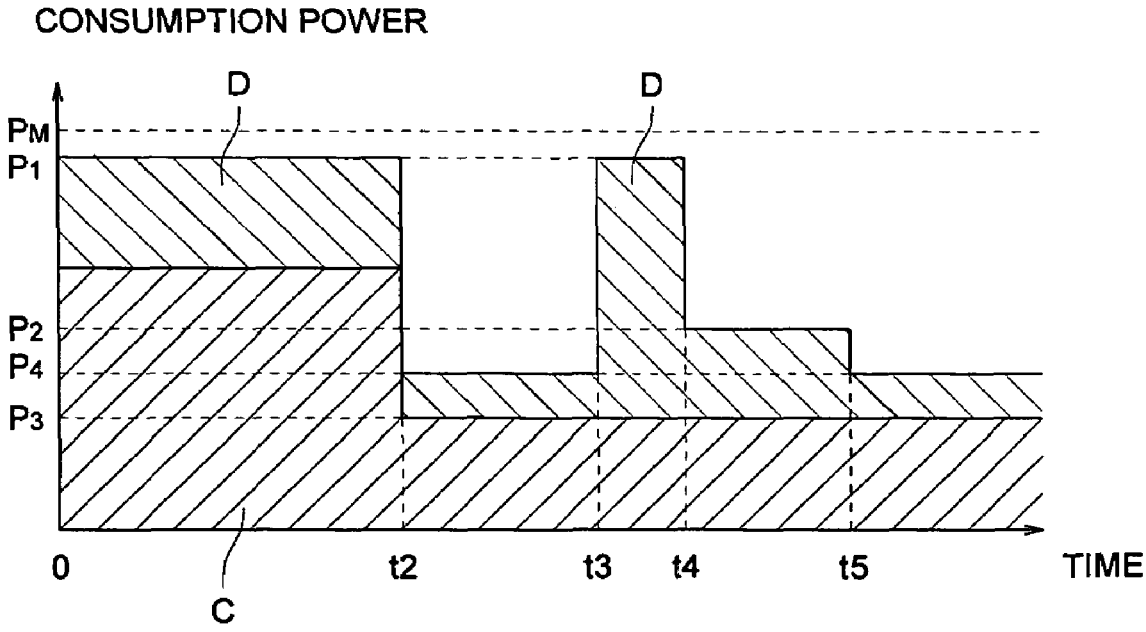

FIGS. 14A and 14B are diagrams showing the relationship of the power consumption of the image forming system to time with the vertical axis representing the power consumption and the horizontal axis representing the elapsed time. The graph in FIG. 14A is for Mode 1 and the graph in FIG. 14B is for Mode 2. In order to simplify the illustration in FIGS. 14A and 14B, only the power consumptions of the heaters that are directly related to warming-up are shown. $P_M$ is a maximum power allowed by the power supply source, and $P_1$ is the maximum power used for warming-up the image forming system 20 of the present embodiment. $P_1$ is set to have a suitable margin with respect to $P_M$. $P_2$ is the standby power consumption of the image forming device A in a state that warming-up of the image forming device A has been completed and the heating units of the bookbinding device B are controlled to be at the first temperature. $P_3$ is the standby power consumption of the image forming system 20 in a state where the warming-up of only the image forming device A has been completed and no current is being supplied to the main heating unit 310, the side-surface heating unit 320, nor side-surface heating unit 330 of the bookbinding device B. $P_4$ is the power consumption of the image forming system 20 in a state where the warming-up of the image forming device A has been completed and the heating units of the bookbinding device B are controlled to be at the second temperature. Herein, since the first temperature is higher than the second temperature, $P_2$ is greater than $P_4$. The region C indicates the power consumption of the image forming device A and the region D indicates the power consumption of the bookbinding device B.

Referring to FIG. 14A (Mode 1), the time '0' is the moment when the power supply to the bookbinding device B is switched on in the flow chart of FIG. 13, and the processing of Step S43 is executed after branching to YES in Step S41. Herein, since the warming-up mode is Mode 1, the warming-up of the image forming device A and the warming-up of the bookbinding device B are started simultaneously. Herein, the power consumption $P_1$ that is close to the power supply capacity $P_M$ of the power source is used in order to complete the warming-up in a shortest possible time. Further, t1 is the moment when warming-up is completed, and thereafter the power consumption decreases to $P_2$.

Referring to FIG. 14B (Mode 2), the time '0' is the moment when the power supply to the bookbinding device B is switched on in the flow chart in FIG. 13. Herein, the bookbinding device B is in the loop of branching to NO in Step S41 of the flow chart, branching to NO in Step S42, executing the processing in Step S44, and returning to Step S41. The control of the heating unit to be at the second temperature is started in Step S44. The time from time 0 to time t2 is the period during which the warming-up of the image forming device A is done simultaneously with the warming-up of the heating units up to the second temperature, and a power consumption value of $P_1$ that is close to the power supply capacity $P_M$ of the power source is used in order to complete the warming-up in a shortest possible time. At t2, the warming-up of the image forming device A and the heating units is completed and the power consumption has decreased to the standby power $P_4$ of the image forming device A.

Further, in Mode 2, since the heating temperature of the main heating unit 310 and of the side-surface heating units 320 and 330 is the second temperature, less power is needed for the heating units compared to that in Mode 1. Therefore, since it is possible to use that decreased amount of electric power for the warming-up of the image forming device A, the time t2 for the completion of the warming of the image forming system 20 becomes shorter than t1.

The moment of time t3 is the point in the flow chart of FIG. 13 when a branch has been made to YES in Step S48 after determining that the bookbinding function setting is present, and the processing of Step S49 is executed. At this point of time, the power supply is switched on to the heater 312 of the main heating unit 310 and the heater 322 of the side-surface heating units 320 and 330 of the bookbinding device B, thereby starting its control to be at the first temperature. Further, a power consumption value of $P_1$ that is close to the power supply capacity $P_M$ of the power source is used in order to complete the warming-up of the heating unit up to the first temperature in a shortest possible time.

The instant of time t4 is the point of time when the warming-up of the heating units is completed at the first temperature, and the power consumption has decreased to the standby power consumption $P_2$ of the image forming system 20 in the state in which the heating units are being controlled at the first temperature.

The moment of time t5 is the point of time when the bookbinding operation of Step S49 in the flow chart of FIG. 13 is completed, the heating-unit-preparation data and the bookbinding execution data in the predetermined areas of memory M2 are released in Step S50, a branch is made to NO in Step S41, a branch is made to NO in Step S42 (here it is assumed that there is no waiting job that has the data of executing bookbinding operation), the control is started towards the second temperature of the heating unit of the bookbinding device in Step S44, and the power consumption decreases to the standby power consumption $P_4$.

As has been described above, when Mode 2 is selected as the warming-up mode, the warming-up of the image forming system 20 is completed in a shorter time compared to that in Mode 1. Further, comparing the standby power consumption, while power $P_2$ is being consumed in Mode 1, the standby power is $P_4$ in Mode 2 until the bookbinding function is selected. Therefore, it is possible to have a lower standby power than during Mode 1.

When control of the heating units to be at the second temperature is started in MOde 2, the warming-up of the image forming device A is already completed at this point of time and the total usable power can be utilized only for warming-up the bookbinding device B. Besides, the warming-up is not from room temperature but from the second temperature. Accordingly, it is possible to complete the warming-up in a relatively short period of time, thereby making the stress on the operator low.

Further, when a plurality of print jobs is waiting, the print job determination unit C12 makes the determination after inspecting all the waiting print jobs. Therefore, even when a print job in which post-processing data has been set is to be executed later than several other print jobs, it is possible to control, in advance, the heating unit to the first temperature and hence it is possible to reduce the waiting time due to warming-up.

Figure 15:
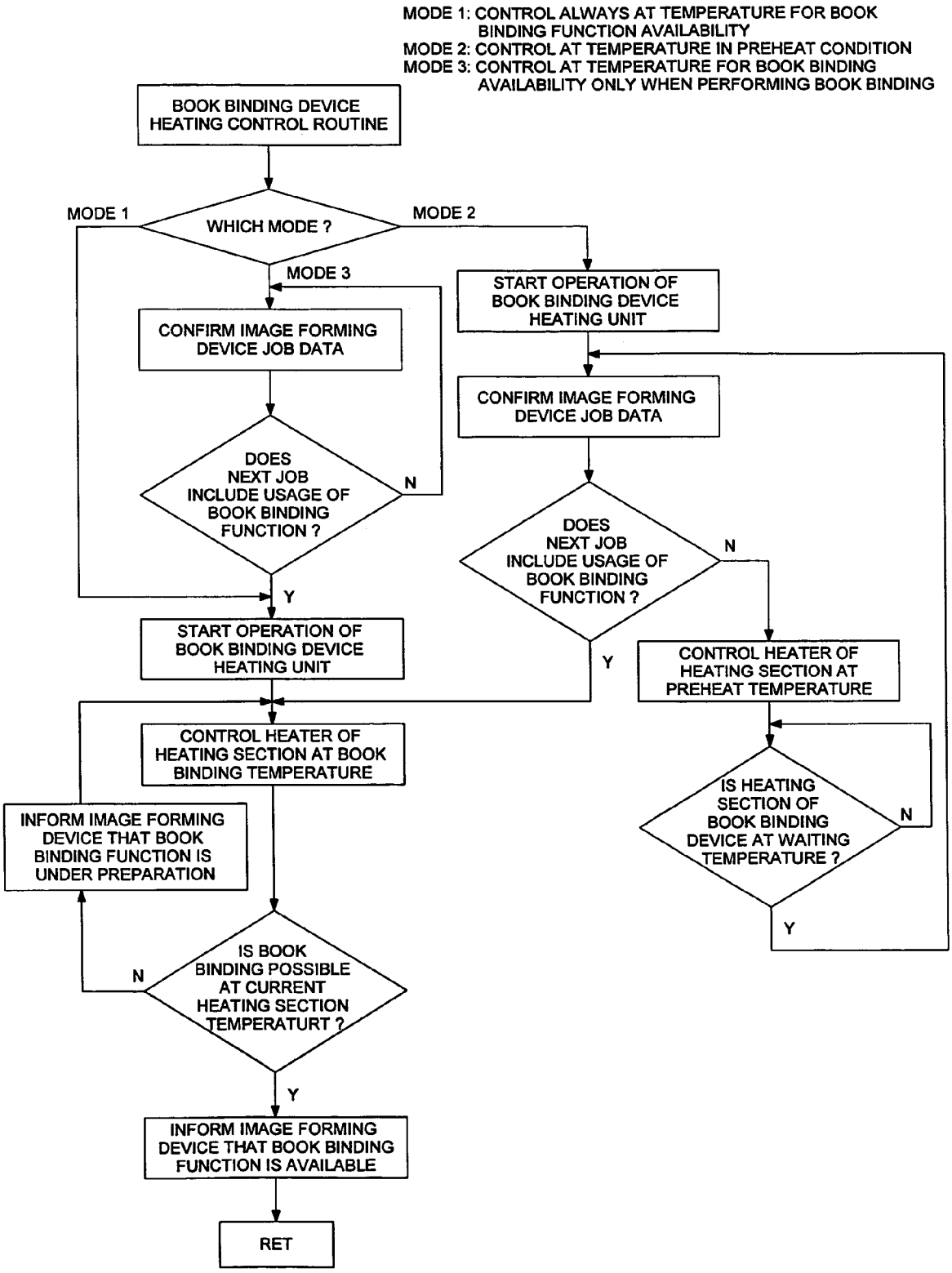
FIG. 15 is a modified example of the third embodiment having three modes.

FIG. 15 shows the present embodiment having three types of modes. In Mode 1, warming-up is carried out so that bookbinding is always possible. In Mode 2, warming-up is carried out, according to a print job. In Mode 3, warming-up is carried out only when bookbinding is to be carried out. Even in this embodiment, it is desirable that if the print job determination unit C12 determines that a waiting job includes post-processing setting, then warming-up of the bookbinding device B is carried out and the heating units are controlled to be at the first temperature, and if there is no waiting job or no post-processing data in waiting jobs, then the heating units are controlled to be at the second temperature which is lower than the first temperature and higher than room temperature.

In the embodiments described above, although the power-supply-switch-on detection unit C22, the bookbinding execution detection unit C23, the heating temperature control unit C24, and the heating-unit-preparation detection unit C25 are all provided in the control unit C2 of the bookbinding device B, it is also possible to install a part or the whole of these in the control unit C1 of the image forming device A. Furthermore, although the job input section in each of the embodiments described above is, for example, an operation panel through which the user inputs jobs, the invention is not limited to this, and it is also possible to input jobs via external equipment or interfaces with networks.

Still further, it is understood that objects of the present invention can also be achieved by providing a recording medium in which are recorded software programs realizing the functions of the embodiments described above to a system or a device, and by having a computer (CPU or MPU) of the system or device read and execute the programs stored in the recording medium.

Yet further, even regarding detailed structures and detailed operations of various elements constructing an image forming system, it is possible to make suitable modifications without deviating from the spirit and scope of the present invention.

In each of the above embodiments, as an example of bookbinding means of a bookbinding device, the descriptions have been given taking examples of a structure having a heating unit for melting a hot melt type adhesive coated on a binding tape. However, the present invention can also be applied to bookbinding means having a structure, for example, in which a bundle of sheets stacked and coated with glue or adhesive heated by a heater on the edge part of the sheets is bound by applying pressure, and can also be applied to bookbinding means having a structure in which a bundle of sheets of bound sheets coated with glue or adhesive on the edge part of the sheets is heated by a heater in order to melt the glue or the adhesive.

Further, regarding the post-processors, although the descriptions have been given, taking examples of bookbinding devices, it is also possible to apply the invention to any post-processor having a heating section.

What is claimed is:

1. An image forming system comprising:

an image forming device; and a post-processor for performing post-processing on a recording medium on which an image has been formed by the image forming device, the post-processor having a heating section;

wherein the image forming system includes:

a first trigger detection section for detecting a first warming-up start trigger;

a second trigger detection section for detecting a second warming-up start trigger;

a control section for controlling warming-up of the heating section; and a setting section for setting a first mode or a second mode, wherein, if the first mode has been set at the setting section, the control section starts warming-up of the heating section in response to a detection of the first warming-up start trigger by the first trigger detection section, and if the second mode has been set at the setting section, the control section starts warming-up of the heating section in response to a detection of the second warming-up start trigger by the second trigger detection section; and wherein the first warming-up trigger includes at least one of switching power on to the post-processor and switching power on to the image forming device, and the second warming-up start trigger is post-processing setting information.

2. The image forming system of claim 1, wherein the second warming-up start trigger is post-processing setting information indicative of a use of the heating section.

3. The image forming system of claim 1, wherein the start of warming-up of the heating section by the control section is a change from a state where no current is applied through the heating section to a state where a current is applied through the heating section.

4. The image forming system of claim 1, wherein the heating section is used to heat a processing material for the post-processing performed by the post-processor.

5. The image forming system of claim 4, wherein the heating section is used for melting an adhesive for binding a bundle of sheets of the recording medium.

6. An image forming system comprising:

an image forming device; and a post-processor for performing post-processing on a recording medium on which an image has been formed by the image forming device, the post-processor having a heating section;

wherein the image forming system includes:

a first trigger detection section for detecting a first warming-up start trigger;

a second trigger detection section for detecting a second warming-up start trigger;

a control section for controlling warming-up of the heating section; and a setting section for setting a first mode or a second mode, wherein, if the first mode has been set at the setting section, the control section starts warming-up of the heating section in response to a detection of the first warming-up start trigger by the first trigger detection section, and if the second mode has been set at the setting section, the control section starts warming-up of the heating section in response to a detection of the second warming-up start trigger by the second trigger detection section;

wherein the image forming device has a mode in which an image forming operation can be performed and a low consumption power mode that consumes less power than the mode in which an image forming operation can be performed; and wherein the first warming-up start trigger is an instruction for a change from the low consumption power mode to the mode in which an image forming operation can be performed, and the second warming-up start trigger is post-processing setting data.

7. The image forming system of claim 6, wherein the second warming-up start trigger is post-processing setting information indicative of a use of the heating section.

8. An image forming system comprising:

an image forming device; and a post-processor for performing post-processing on a recording medium on which an image has been formed by the image forming device, the post-processor having a heating section;

wherein the image forming system includes:

a first trigger detection section for detecting a first warming-up start trigger;

a second trigger detection section for detecting a second warming-up start trigger;

a control section for controlling warming-up of the heating section; and a setting section for setting a first mode or a second mode, wherein, if the first mode has been set at the setting section, the control section starts warming-up of the heating section in response to a detection of the first warming-up start trigger by the first trigger detection section, and if the second mode has been set at the setting section, the control section starts warming-up of the heating section in response to a detection of the second warming-up start trigger by the second trigger detection section;

wherein the image forming device comprises a fixing unit having a heater; and wherein the first warming-up start-trigger includes at least one of switching power on to the post-processor and switching power on to the image forming device, and the second warming-up start trigger is warming-up completion of the fixing unit.

9. An image forming system comprising:

an image forming device including a fixing unit which fixes an image on a recording medium by heating;

a bookbinding device including a bookbinding unit provided with a heating unit which melts an adhesive for binding a bundle of sheets of the recording medium; and a control unit for controlling warming-up of the bookbinding device so that the warming-up of the bookbinding device is performed after completion of warming-up of the image forming device;

wherein the image forming device and the bookbinding device are connected with each other; and wherein the image forming device has a mode in which an image forming operation can be performed and a low consumption power mode that consumes less power than the mode in which an image forming operation can be performed, and the warming-up of the bookbinding device is performed after an instruction for a change from the low consumption power mode to the mode in which an image forming operation can be performed.

* * * * *